US005134873A

United States Patent [19]

Miyagawa et al.

[11] Patent Number: 5,134,873

[45] Date of Patent: Aug. 4, 1992

[54] DIE EXCHANGE APPARATUS FOR THE USE OF A PRESS BRAKE

[75] Inventors: Naoomi Miyagawa, Gifu; Chiyoaki Yoshida, Aichi; Kazuyuki Toda, Aichi; Yukiyasu Nakamura, Aichi, all of Japan

[73] Assignee: Yamazaki Mazak Kabushiki Kaisha, Japan

[21] Appl. No.: 507,137

[22] Filed: Apr. 10, 1990

[30] Foreign Application Priority Data

| | | | |
|---|---|---|---|
| Apr. 10, 1989 | [JP] | Japan | 1-90083 |
| Apr. 10, 1989 | [JP] | Japan | 1-90084 |
| Apr. 10, 1989 | [JP] | Japan | 1-90085 |

[51] Int. Cl.[5] ..... B21J 13/08

[52] U.S. Cl. ..... 72/446; 72/389; 72/413; 72/478

[58] Field of Search ..... 29/568; 72/319, 320, 72/389, 446, 413, 478, 482

[56] References Cited

U.S. PATENT DOCUMENTS

| | | | |
|---|---|---|---|
| 4,532,792 | 8/1985 | Hongo | 72/319 |
| 4,660,402 | 4/1987 | Hongo | 72/319 |
| 4,680,955 | 7/1987 | Sakamoto | 72/446 |
| 4,930,332 | 6/1990 | Hongo | 72/446 |

FOREIGN PATENT DOCUMENTS

| | | | |
|---|---|---|---|
| 308363 | 3/1989 | European Pat. Off. | 72/446 |
| 219431 | 9/1986 | Japan | 72/446 |
| 57717 | 3/1987 | Japan | 72/446 |

*Primary Examiner*—David Jones

*Attorney, Agent, or Firm*—Eckert, Seamans, Cherin & Mellott

[57] ABSTRACT

A press brake has upper dies and lower dies so as to be capable of attaching and detaching with an upper die exchange apparatus and a lower die exchange apparatus to a machine body of the press brake. And, the upper die and the lower die comprise the combination of divisional die chips. The storing of dies is performed with those die chips. And, the face width of the upper die chips is determined and combined according to size of a workpiece to be processed from the upper die chips.

8 Claims, 21 Drawing Sheets

DIE EXCHANGE APPARATUS FOR THE USE OF A PRESS BRAKE

BACKGROUND OF THE INVENTION

This invention relates to a die exchange apparatus for the use of a press brake, capable of automatically exchanging dies in a press brake without requiring an assistance of a person.

There are only a few kinds of dies capable of automatically exchaging in this kind of a die exchange apparatus so far.

However, it is difficult to apply such a die exchange apparatus to various kinds of press operations and unmanned operation in recent years. Therefore, the demand for a die exchange apparatus capable of freely exchanging and using various kinds of dies is going to be high.

In such a die exchange apparatus, it is necessary to determine face width of various kinds of dies to be used for machining. Besides, the method of storing various kinds of dies to be used for machining is to be studied.

SUMMARY OF THE INVENTION

A first object of the present invention is to provide a die exchange apparatus for the use of a press brake, capable of automatically executing exchange operations of various kinds of dies in a short time without requiring an assistance of a person.

And, a second object of the present invention is to provide a die exchange apparatus for the use of a press brake such that a die having proper face width can comprise divisional dies.

Furthermore, a third object of the present invention is to provide a die exchange apparatus for the use of a press brake, capable of efficiently and divisionally storing various kinds of dies.

In the present invention, a press brake has an upper body and a lower body, said upper body and lower body having an upper die holder and a lower die holder attachably and detachably held thereby, respectively. The press brake is provided with an upper die exchange apparatus and a lower die exchange apparatus. The upper die exchange apparatus has a pair of first support arms provided at the position corresponding to the upper body so as to be free to be moved in a vertical direction, subarms provided on the first support arms so as be free to be rotated and positioned about horizontal first rotational shafts, respectively and support means for the upper die holder provided at the top edge of each subarm so as to be symmetrical about the first rotational shaft and so as to face each other in a horizontal direction. The lower die exchange apparatus has a pair of second support arms provided at the position corresponding to the lower body so as to be free to be moved in a vertical direction, subarms provided on the second support arms so as be free to be rotated and positioned about horizontal second rotational shafts, respectively and support means for the lower die holder provided at the top edge of each subarm so as to be symmetrical about the second rotational shaft and so as to face each other in a horizontal direction.

With the above-described constitution, exchange operations of dies in a press brake can be automatically executed with the upper die exchange apparatus and the lower die exchange apparatus without requiring an assistance of a person. Besides, while a holder installing dies to be exchanged is held with one support means, a holder installing unnecessary dies can be detached from a press brake side with the other support means. Because the support means of the upper die holder and the lower die holder is provided so as to be symmetrical about the rotational axis. Accordingly, rapid die exchange can be executed. Furthermore, various kinds of dies can be freely supplied with the support means of the die holder, and therefore, there is no limit to kinds of dies capable of exchanging. This feature is very convenient.

And, this invention provides a die exchange apparatus capable of exchanging of dies in a press brake, having an upper body attachably and detachably holding an upper die holer and a lower body attachably and detachably holding a lower die holder. The die exchange apparatus has a die select combination unit. The die select combination unit has a first die support mean holding one or more divisional dies having one or more kinds of face width in order of a predetermined arrangement so as to be free to be attached and detached selectively, a second die support means provided so as to be capable of holding one or more divisional dies among the above-mentioned divisional dies, a die support release means provided so as to be capable of releasing the support state of the divisional dies of the first die support means selectively and a die select transfer means provided being relatively movable between the first die support means and the second die support means, such that the die select transfer means selectively detaches the divisional dies supported with the first die support means from the first die support means and transfers those divisional dies to the second die support means.

With the above-described constitution, the divisional dies supported with the first die support means are selected with the die select transfer means and transferred so as to have proper face width to the second die support means. Accordingly, dies having various kinds of face width can be freely combined and various kinds of machinings can be performed with a press brake.

Furthermore, this invention provides a die exchange apparatus capable of exchanging dies for a press brake, said press brake having an upper body and a lower body, said upper body and lower body having an upper die holder and a lower die holder attachably and detachably held thereby. The die exchange apparatus has a die storing unit. The die storing unit has a first chain carrying unit, a second chain carrying unit and a third chain carrying unit. The first chain carrying unit has a plurality of first chain having no end provided at predetermined intervals and a plurality of third die support means provided between the first chains. The third die support means supports a standard length upper die comprising an upper die so as to be free to be attached and detached. The second chain carrying unit has a plurality of second chain having no end provided at predetermined intervals and a plurality of fourth die support means provided between the second chains. The fourth die support means supports a divisional upper die comprising an upper die so as to be free to be attached and detached. The third chain carrying unit has a plurality of third chain having no end provided at predetermined intervals and a plurality of fifth die support means provided between the third chains. The fifth die support means supports an unit lower die comprising an lower die so as to be free to be attached and detached.

With the above-described constitution, various kinds of dies to be used in a press brake can be divisionally stored in each chain carrying unit. This feature can be applied for various kinds of machinings in a press brake and an unmanned operation. Besides, the number of dies capable of storing can be freely changed by changing the length of a chain of each chain carrying unit and a die exchange apparatus having extendability can be provided.

DESCRIPTION OF THE PREFERRED EMBODIMENT

The preferred embodiment of the present invention will now be described hereinafter with reference to the accompanying drawings.

Figure 1:
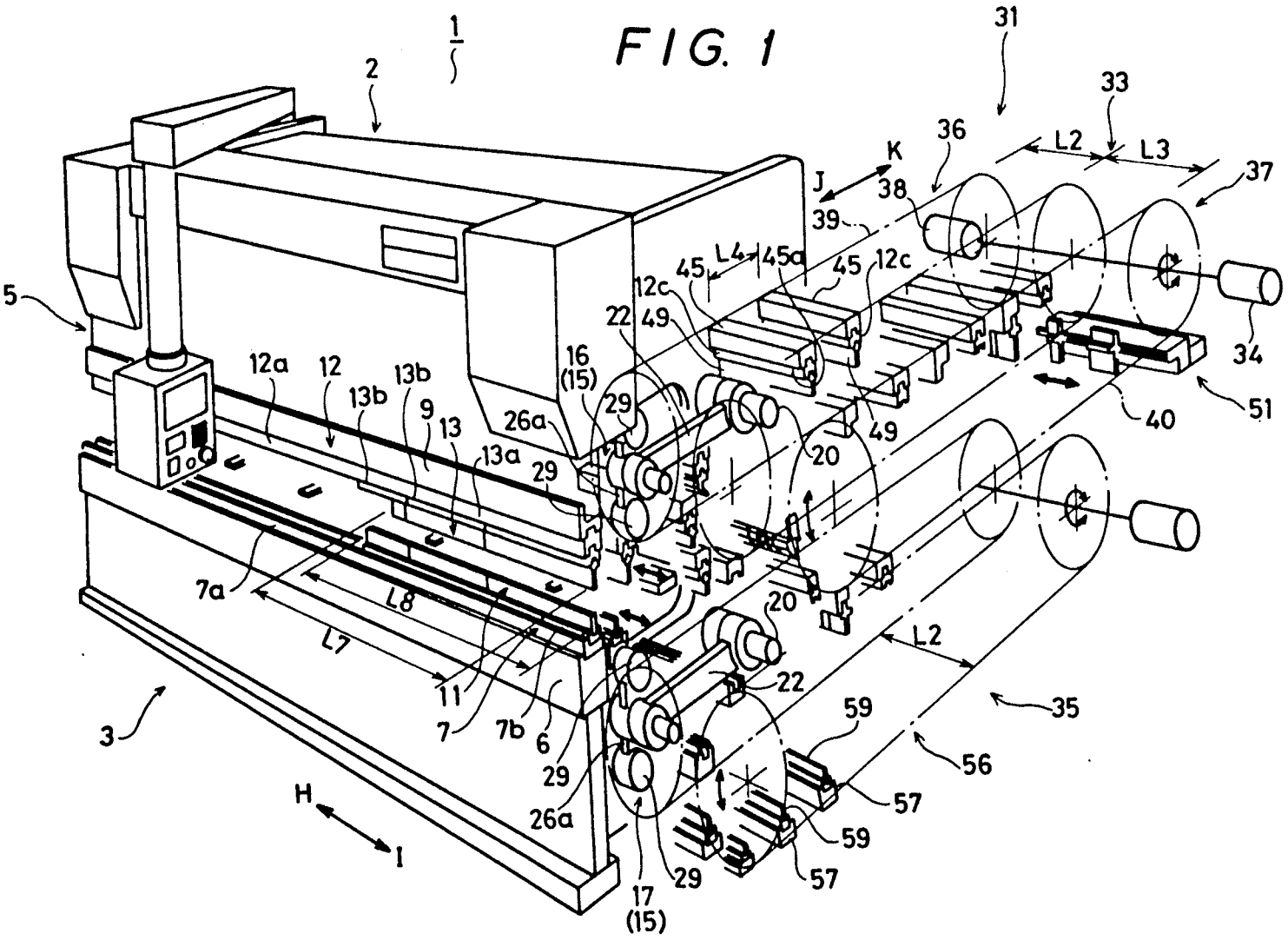
FIG. 1 is a perspective view showing an example of a press brake for which an embodiment of a die exchange apparatus for the use of a press brake according to the present invention is applied.
Figure 21:
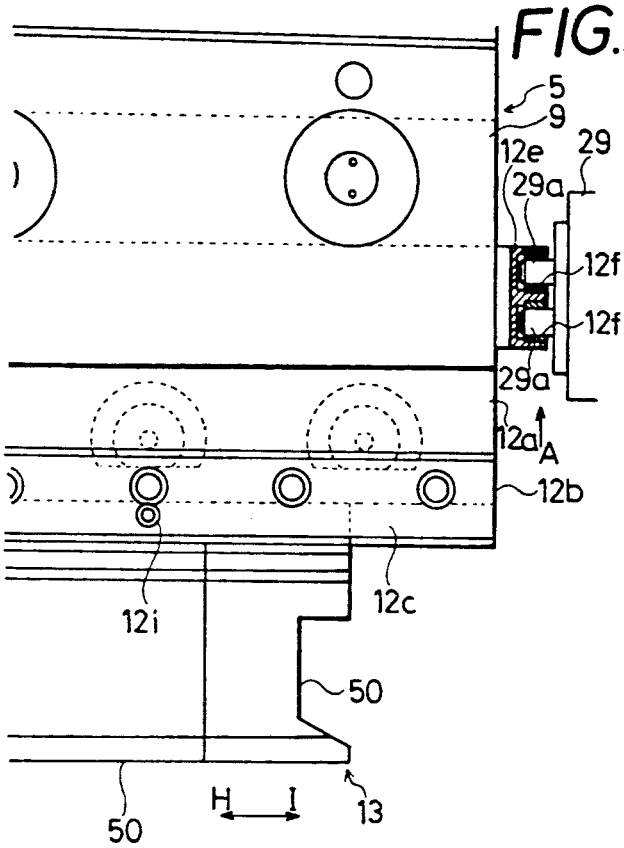
FIG. 21 shows an engagement relation between a die holder and the die exchange apparatus.
Figure 20:
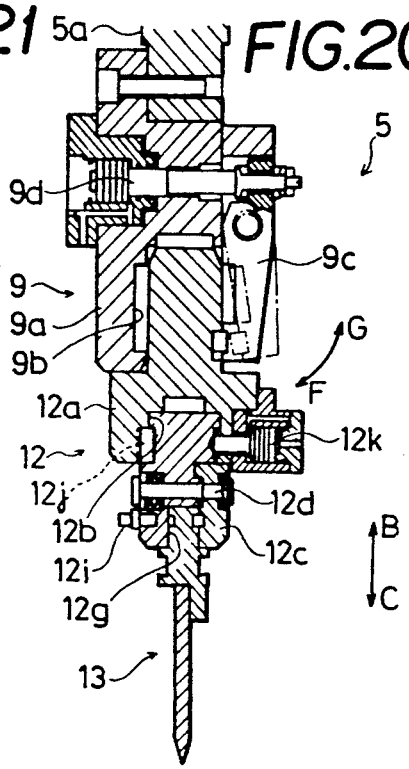
FIG. 20 is a sectional view of the part of a die support unit of the press brake.
Figure 20:
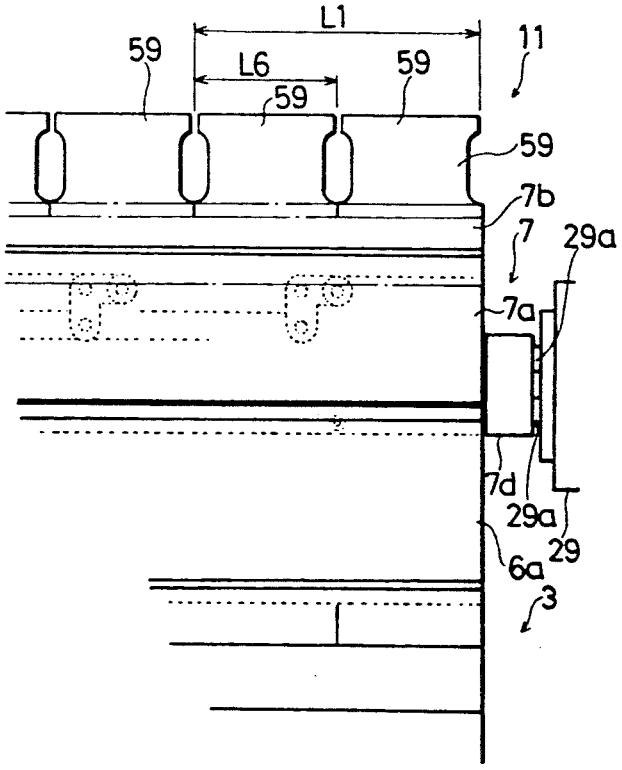
Figure 20:
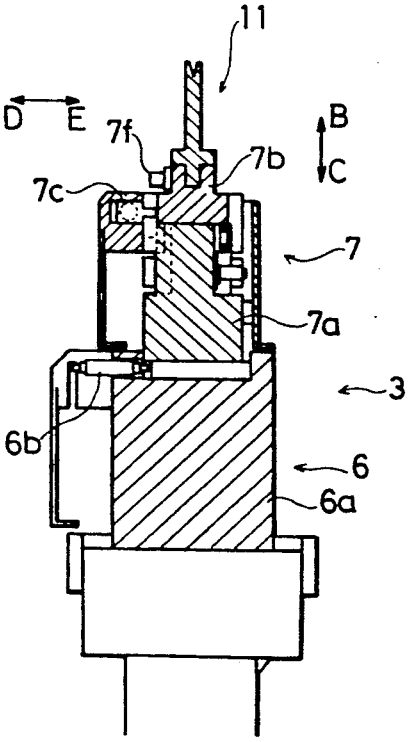

A press brake 1 has a main body 2, as shown in FIG. 1. The main body 2 has a lower body 3 provided at the lower portion of FIG. 1 and an upper body 5 provided above the lower body 3. The lower body 3 is provided with a lower die holding unit 6 as shown in FIG. 20. The lower die holding unit 6 has a base 6a. On the base 6a, a lower die holder 7 is provided so as to be free to be attached and detached in the directions of the arrows B and C in the figure. And, the base 6a is provided with holder clamp cylinders 6b at predetermined intervals in the direction perpendicular to the paper face of the figure. The lower die holder 7 can be held with the lower die holding unit 6 by driving and protruding the clamp cylinder 6b in the direction of the arrow E. The lower die holder 7 has a main holder 7a extending along the entire length of the lower body 3, as shown in FIG. 1. At the upper face of the main holder 7a in the figure, a subholder 7b is provided so as to be held with a clamp cylinder 7c as shown in FIG. 20 on the main holder 7a. The subholder 7b has a predetermined length of L1, as shown in FIG. 21. On each subholder 7b, a lower die 11 is installed.

Figure 22:
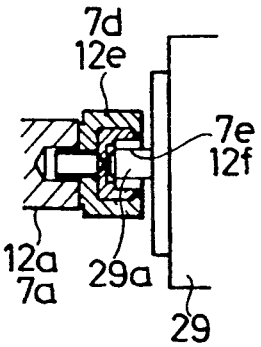
FIG. 22 is a view seen by the arrow A of FIG. 21.

On the other hand, the upper body 5 is provided with a ram 5a so as to be free to be moved and driven in the directions of the arrows B and C, as shown in FIG. 20. At the lower portion of the ram 5a in the figure, an upper die support unit 9 is provided. The upper die support unit 9 has a main body 9a installed in the ram 5a. The main body 9a is provided with a holding groove 9b in the direction perpendicular to the paper face. In the right hand of the main body 9a in the figure, a clamper 9c is supported so as to be free to be rotated and moved in the directions of the arrows F and G through a driving cylinder 9d providing the main body 9a. The holding groove 9b is provided with an upper die holder 12 so as to be free to be attached and detached in the directions of the arrows B and C. The upper die holer 12 has a main holder 12a. The main holder 12a extends along almost the entire length of the upper body 5, as shown in FIG. 1. At the lower portion of the main holder 12a in the figure, a holding groove 12b is formed in the direction perpendicular to the paper face in FIG. 20. A plurality of subholders 12c, having a predetermined length, are installed in the holding groove 12b in the directions of the arrows H and I of FIG. 21. In the lower hand of the subholder 12c of FIG. 20, an upper die 13 is provided so as to be free to be attached and detached by a holding pin 12d providing the subholder 12c. At both sides of the lower die holder 7 and the upper die holder 12, holder supporters 7d, 12e are provided, as shown in FIG. 21. The holder supporters 7d, 12e are provided with two holding holes, 7e and 12f, as shown in FIG. 21 or FIG. 22.

Figure 2:
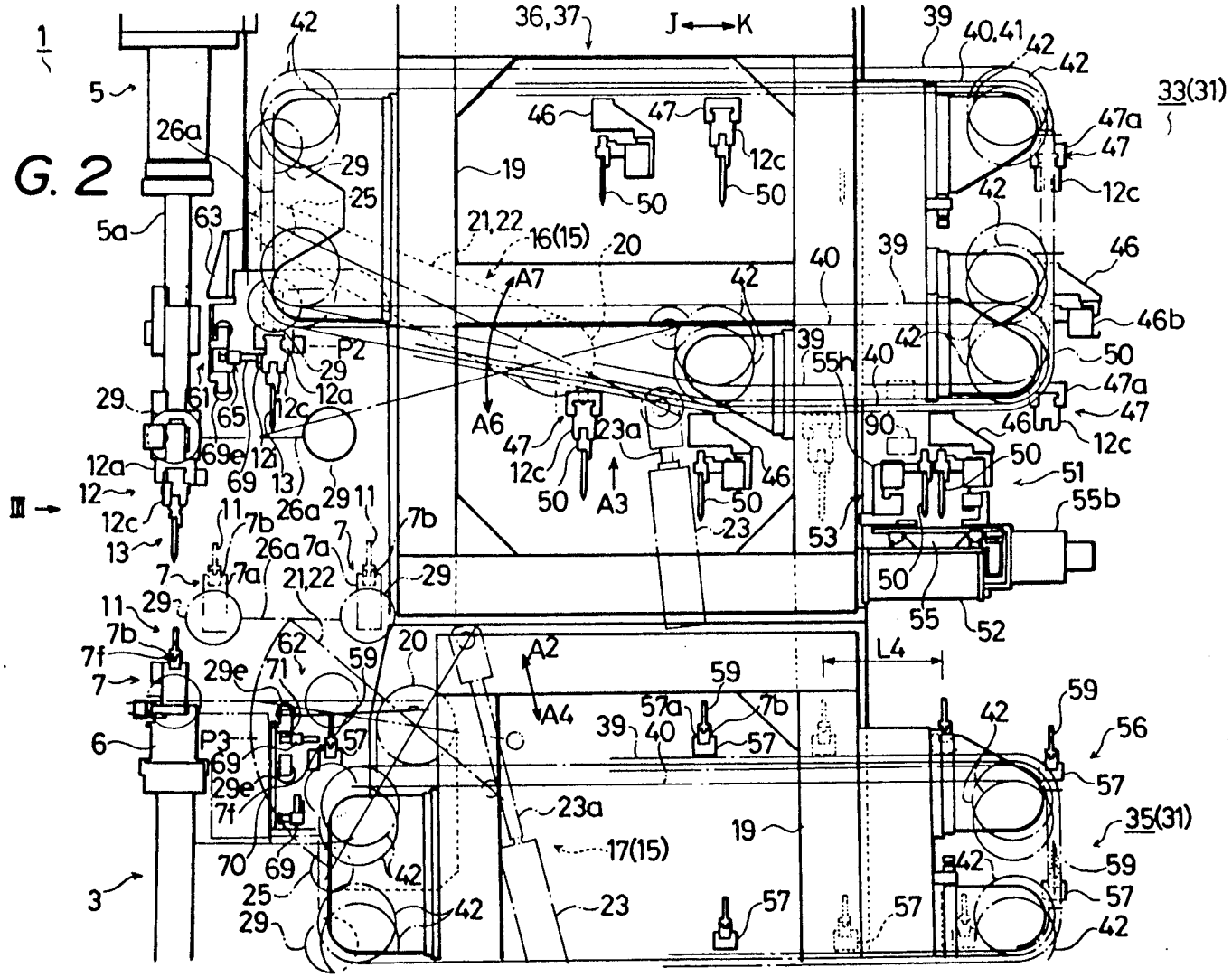
FIG. 2 is a side elevation showing an example of a press brake for which an embodiment of the die exchange apparatus is applied.
Figure 4:
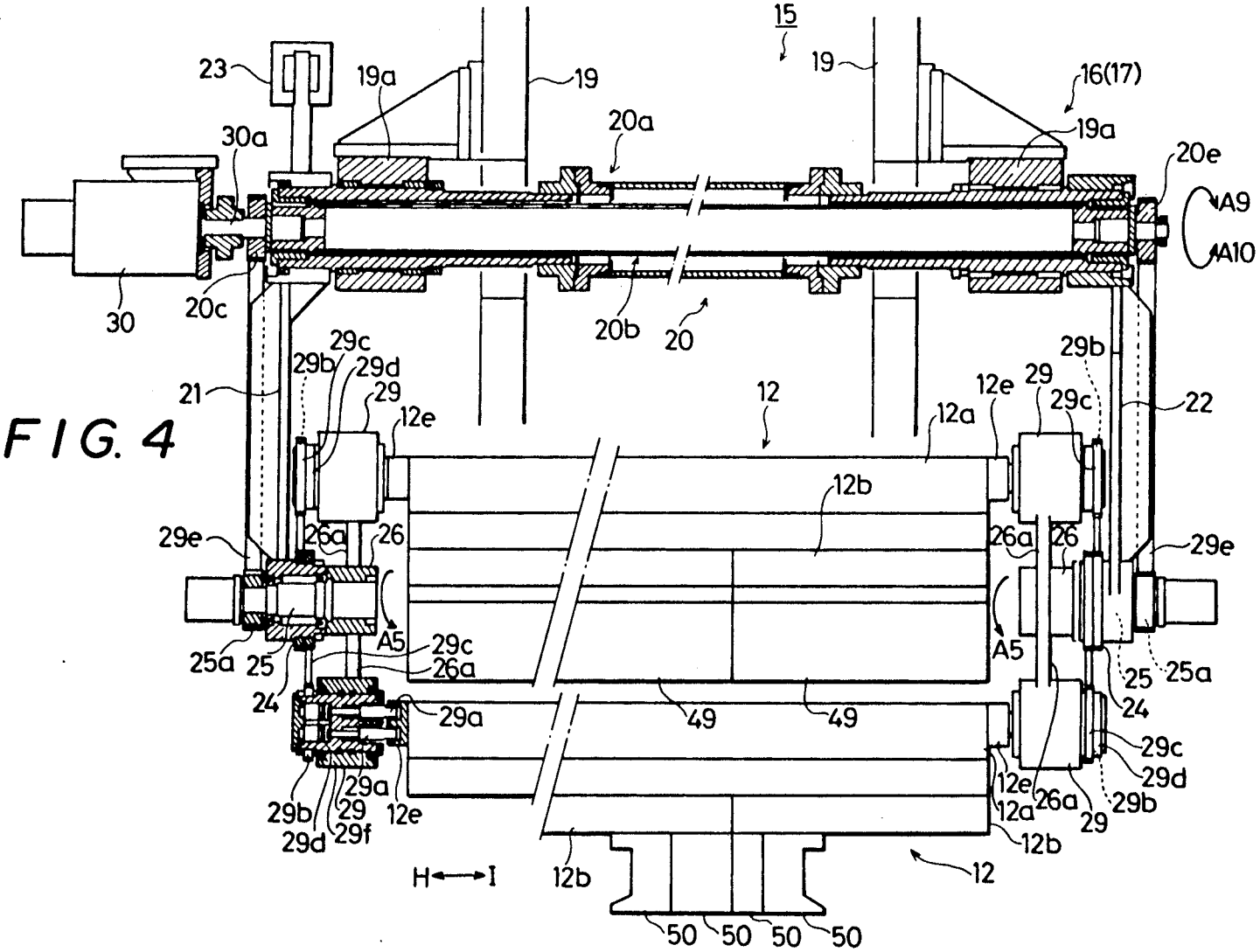
FIG. 4 is a top view showing an example of an upper die exchange apparatus.

Behind the main body 2 of the press brake 1 of FIG. 1, a die exchange apparatus 15 is provided. The exchange apparatus 15 has an upper die exchange apparatus 16 which is located behind the upper body 5 for the exchange of the upper die holder 12 and a lower die exchange apparatus 17 which is located behind the lower body 3 for the exchange of the lower die holder 7. And, the die exchange apparatus 15 has a frame 19, as shown in FIG. 4. The frame 19 is provided with bearings 19a, 19a. Since with respect to a constitution, will be described hereinafter, the upper die exchange apparatus 16 is quite the same as the lower die exchange apparatus 17, explanations of the upper die exchange apparatus 16 are given and those of the lower die exchange apparatus 17 are omitted. The bearings 19a, 19a are provided with a driving shaft 20 so as to be free to be rotated and driven in the directions of the arrows A9 and A10. The driving shaft 20 is double shaft hollow arrangement. The driving shaft 20 has a first hollow shaft 20a forming the contour of the driving shaft 20, being rotatably supported by the bearings 19a and 19a. Inside the first hollow shaft 20a, a second hollow shaft 20b is supported being rotatable about the first hollow shaft 20a. At the both end portion of the first hollow shaft 20a in FIG. 4, arms 21 and 22 are provided. At the upper end of the arm 21 in the figure, a driving cylinder 23 is connected through a ram 23a, as shown in FIG. 2. The top edge of the arms 21, 22 extends in the lower direction in FIG. 4. And, at the top edge portion, shafts 25, 25 are rotatably installed so as to have a horizontal rotational center, respectively. Inside each shaft 25, that is to say, inside the arms 21, 22, a sleeve 26 is provided so as to be fixed on the rotational shaft 25. The sleeve 26 is provided with subarms 26a, 26a so as to be straight arranged with the sleeve 26 as its center, that is, so as to be symmetrically arranged at intervals of 180°. At the top edge of the subarms 26a, 26a, holders 29, 29 are respectively provided. And, a rotational cylinder 29d is only rotatably supported with each holder 29. The rotational cylinder 29d is provided with two holding pins 29a so as to be free to be protruded and driven in the directions of the arrows H and I. And, a gear 29b is installed in the rotational cylinder 29d. The gear 29b is engaged with a gear 24 fitted into a boss portion of the top edge of the arms 21, 22 through a timing belt 29c. And, a gear 25a is fitted outside the shaft 25 in FIG. 4. A gear 25a is engaged with the gear 20c fitted into the second hollow shaft 20b through a timing belt 29e. An output shaft 30a of a driving motor 30 is engaged with the gear 20c.

Figure 3:
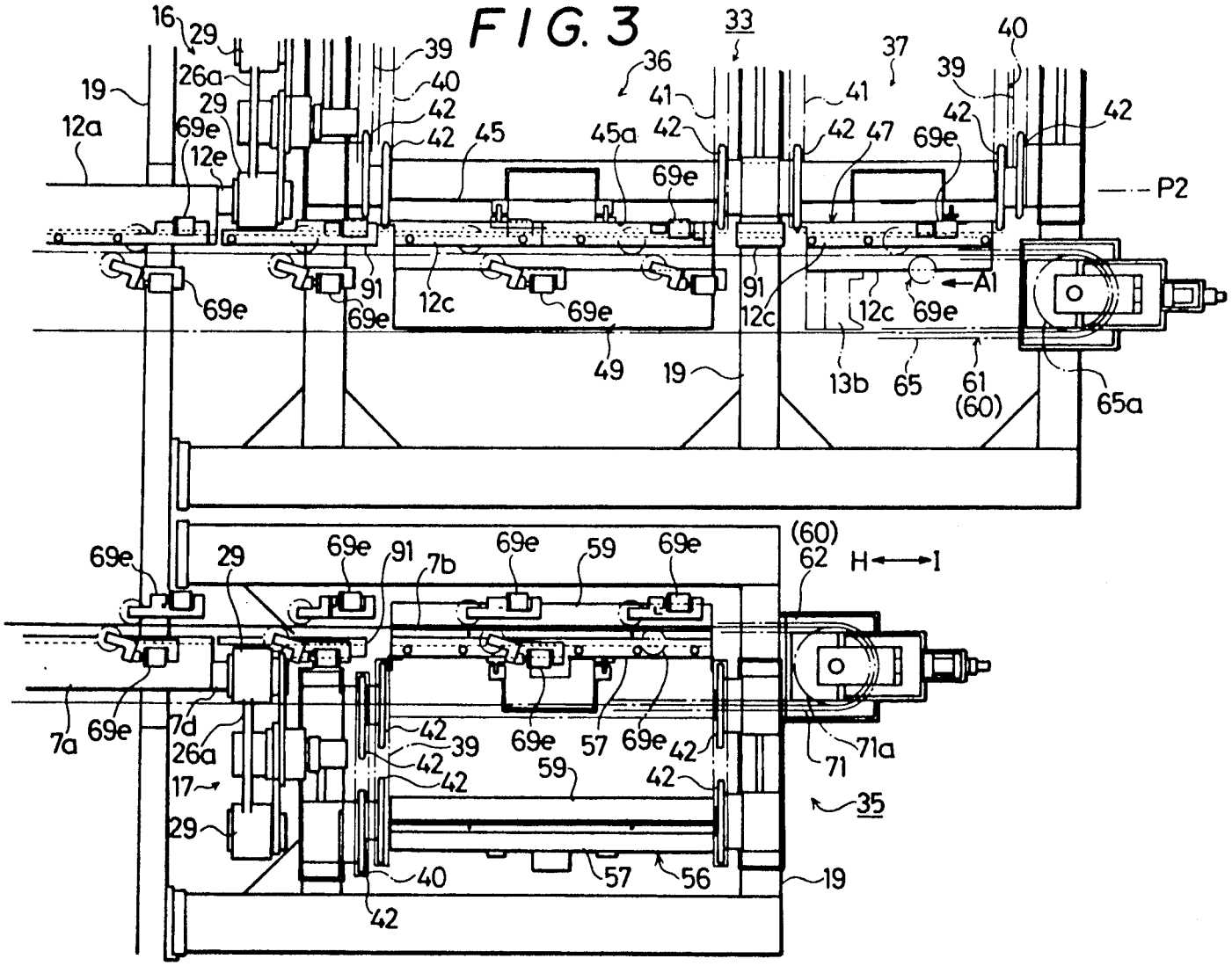
FIG. 3 is a view seen by the arrow III of a die storing unit of FIG. 2.
Figure 18:
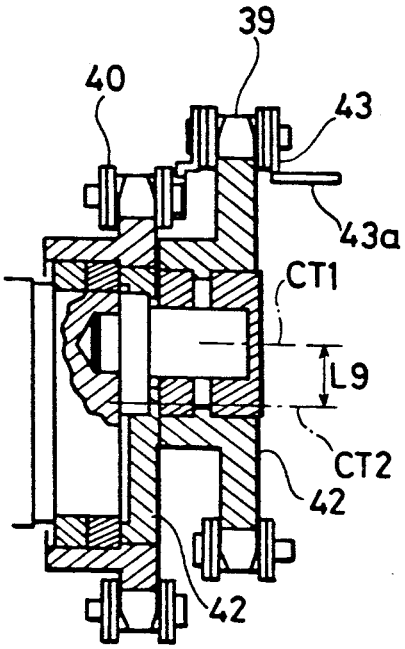
FIG. 18 is a front elevation showing details of a chain drive mechanism.
Figure 19:
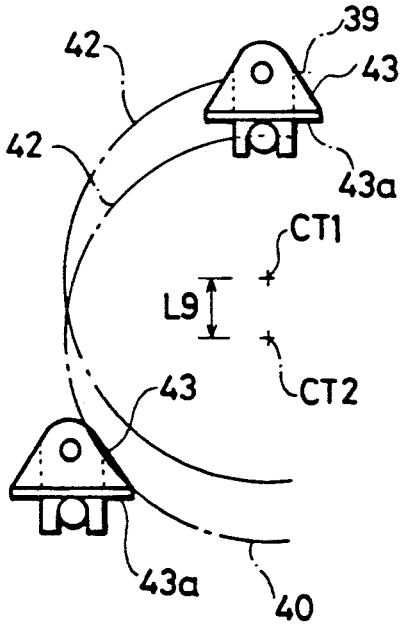
FIG. 19 is a side elevation of FIG. 18.

In the right hand of the press brake 1 in FIG. 1, a die storing unit 31 is provided. The die storing unit 31 is provided with an upper die storing unit 33 for storing upper dies and a lower die storing unit 35 for storing lower dies. The upper die storing unit 33 has a chain carrying unit 36, having a width of L2, as shown in FIG. 1. In the right hand of the chain carrying unit 36 in the figure, a chain carrying unit 37 is provided so as to have a width of L3. The width L2 of the chain carrying unit 36 is almost twice as long as the width L3 of the carrying unit 37. The chain carrying unit 36 has two chains, 39 and 40, in the left hand in the figure, and a chain 41 in the right hand in the figure, as shown in FIG. 3. The chains 39, 40, 41 are respectively wound by a plurality of sprockets 42 in such a manner that these chains have no end, as shown in FIG. 2. The sprockets 42 of the chains 39, 40 in the left hand in FIG. 3 are provided in such a manner that their rotational centers CT1, CT2 depart a predetermined distance L9 from each other in the upper and lower directions in the figure, as shown in FIG. 18 or 19. A bracket 43 is provided between the chains 39 and 40. The bracket 43 acts so as to always keep a die installation face 43a horizontal owing to the action of the above-mentioned chains 39, 40. Since such a constitution that the chains 39, 40 are shifted a predetermined distance and the position of an object held with chains is maintained is known as so-called "double chain", its detailed explanations will be omitted. At the position facing the installation position of the brackets 43 of the chains 39, 40, a similar bracket (not shown) of the chain 41 is installed. A die support unit 45 is installed between the chains 39, 40 and the chain 41 through the brackets 43 and the like so as to always face its installation portion 45a to the lower portion by the double chain. A plurality of the die support unit 45 are provided at predetermined intervals of L4 in the carrying direction of the chain carrying unit 36, that is, in the directions of the arrows J and K. Standard length upper dies 49, having various forms, are hanged from respective die support units 45 through the subholder 12c. The standard length upper die 49, held at the chain carrying unit 36 side, has a standard face width L5 of 835 mm, for instance as shown FIG. 9 or 10. And, one standard length upper die 49 is held with each of the support units 45.

Figure 5:
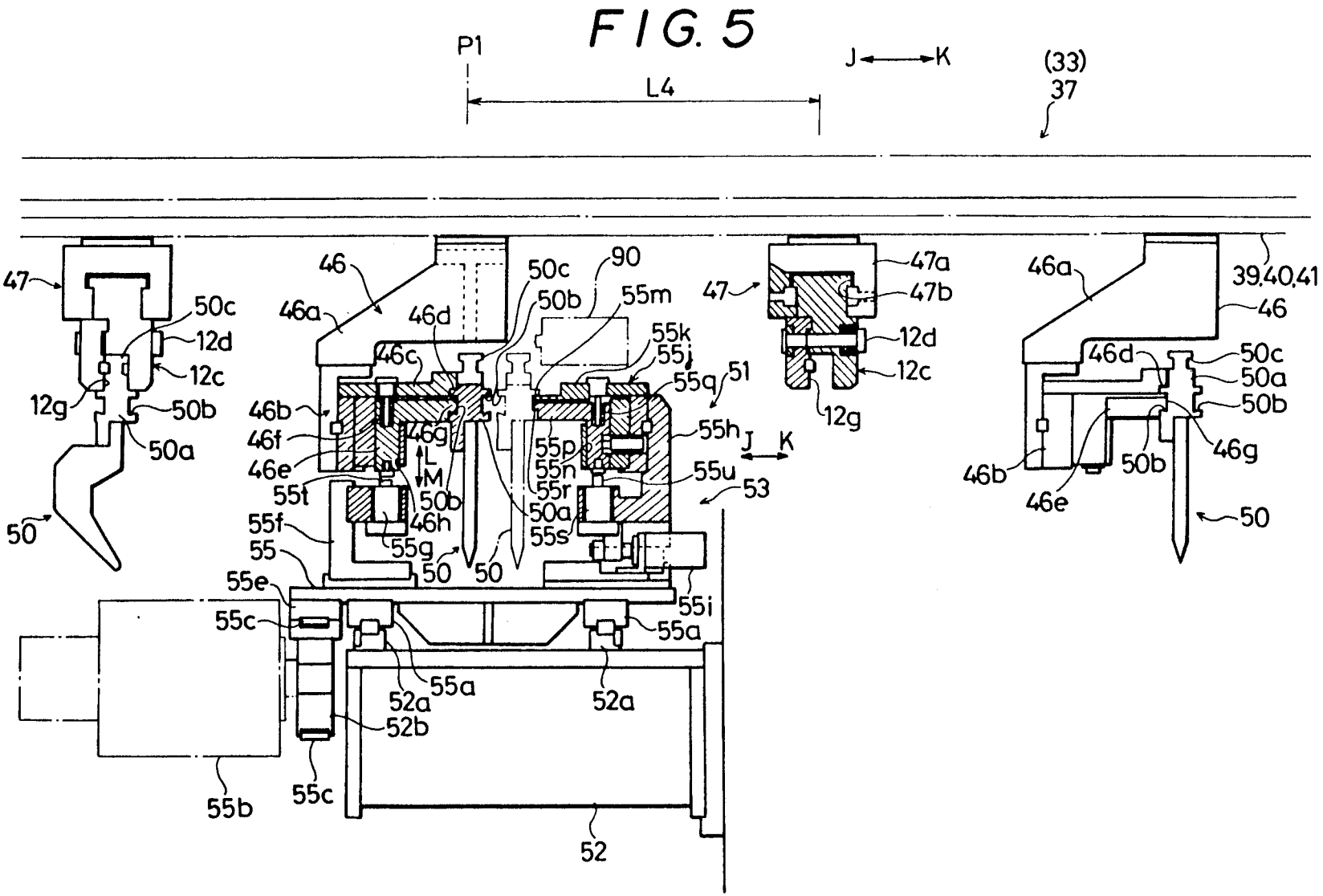
FIG. 5 is a side elevation showing a die select station.
Figure 7:
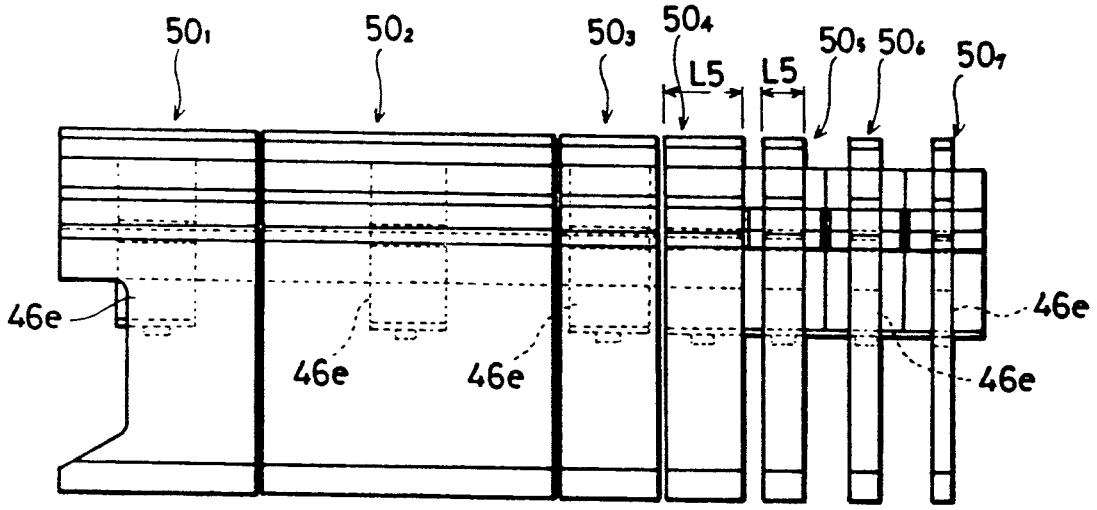
FIGS. 7 and 8 show an example of divisional dies installed in a divisional die holder.
Figure 8:
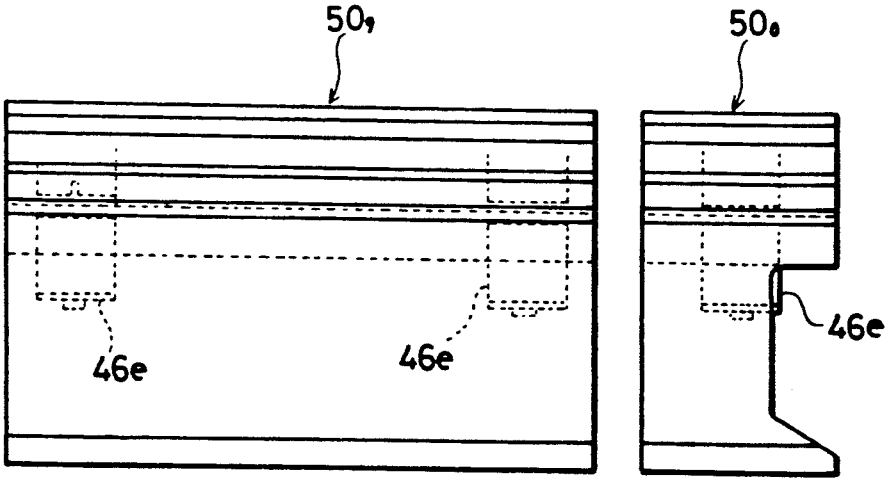

The constitution of the chain carrying unit 37 is almost the same as that of the chain carrying unit 36. Then, the same elements are marked with the same numerals, and the explanation of these elements will be omitted. The chain carrying unit 37 has two kinds of die support units, as shown in FIG. 5. One is a divisional die support unit 46, and the other is a combination die support unit 47. The combination die support unit 47 and the divisional die support unit 46 are installed at predetermined intervals of L4 in the carrying direction of the chain carrying unit 37, that is, in the directions of the arrows J and K so as to pair by being arranged one after the other. One or more divisional upper dies 50, having various face width L5, are installed in the divisional die support unit 46 in order of a predetermined arrangement, that is, in such an order that the closer to the right hand from the left hand in the figure, the narrower the face width L5 is, as shown in FIG. 7 or FIG. 8. With respect to dies 50 held with the divisional die support unit 46, which are narrow in face width, the support form in the support unit 46 is always constant. For instance, as shown in FIG. 7, an edge portion installation die $50_1$, and six divisional upper dies $50_2$, $50_3$, $50_4$, $50_5$, $50_6$, $50_7$ (in order of size of the face width L5) are installed in order from left to right in the figure. The detailed explanation of the installation form will now be given. The divisional die support unit 46 has a main body 46a in the form of inverted L, as shown in FIG. 5. The main body 46a is provided with a clamper 46b. The clamper 46b has a bracket 46c provided so as to protrude in the right hand in the figure. At the top edge of the bracket 46c, an engagement groove 46d is formed. In the lower hand of the bracket 46d, holes 46h are formed so as to correspond to each of divisional dies 50, which is supported with the support unit 46. In each hole 46h, a slider 46e is provided so as to be always energized in the direction of the arrow M owing to elasticity of a coiled spring 46f. At the top edge of the slider 46e, an engagement portion 46g is provided. With the engagement portion 46g, the divisional dies 50 supported with the support unit 46 are held so as to engage the engagement portion 46g with an engagement groove 50b formed at the side face of a holding portion 50a. With respect to the divisional die 50 which is broad in face width as shown in FIG. 8, two or more sliders 46e holding the dies are provided in its face width direction.

Figure 11:
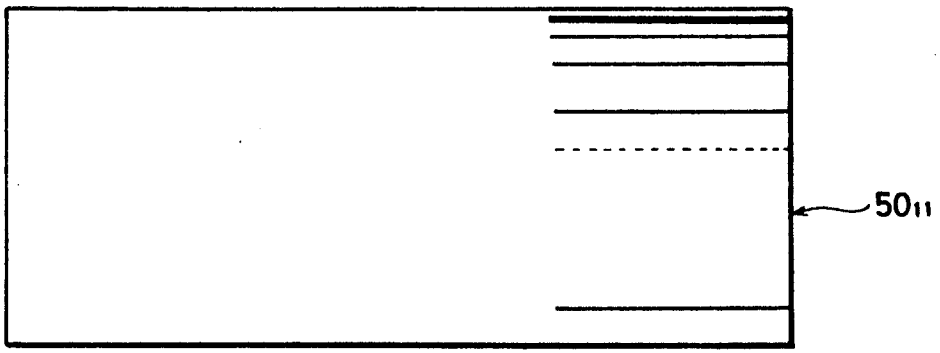
FIG. 11 is a front elevation showing the divisional die.

The divisional die support unit 46 comprises the combination of a die $50_9$ which is broader in face width, and an edge portion installation die $50_0$ as shown in FIG. 8 as well as the combination of the dies 50 as shown in FIG. 7. Furthermore, as shown in FIG. 11, such a case that a die $50_{11}$, having a half width as long as that of the standard length upper die 49, is supported with the divisional die support unit 46 is also available.

Figure 15:
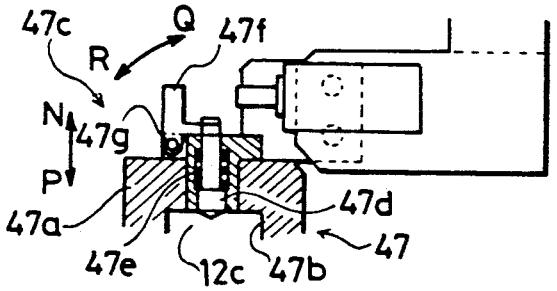
FIG. 15 shows a lock device.

And, the combination die support unit 47 has a main body 47a in the form of C. At the main body 47a, a groove 47b is formed in the direction perpendicular to the paper face in FIG. 5. In the groove 47b, the subholder 12c is provided so as to be capable of being attached and detached in the direction perpendicular to the paper face. At the upper portion of the main body 47a, a lock device 47c is provided such that the subholder 12c can be fitted in a groove 47b, as shown in FIG. 15. The lock device 47c has a lock pin 47d such that the lock pin 47d is free to be moved in the directions of the arrows N and P. The lock pin 47d is always energized by a coiled spring 47e casing the circumference of the lock pin 47d in the direction of the arrow P. And, the top edge of a lock release lever 47f is engaged with the top edge of the lock pin 47d. The lock release lever 47f is rotatably and movably supported through a pin 47g in the directions of the arrows Q and R.

Figure 6:
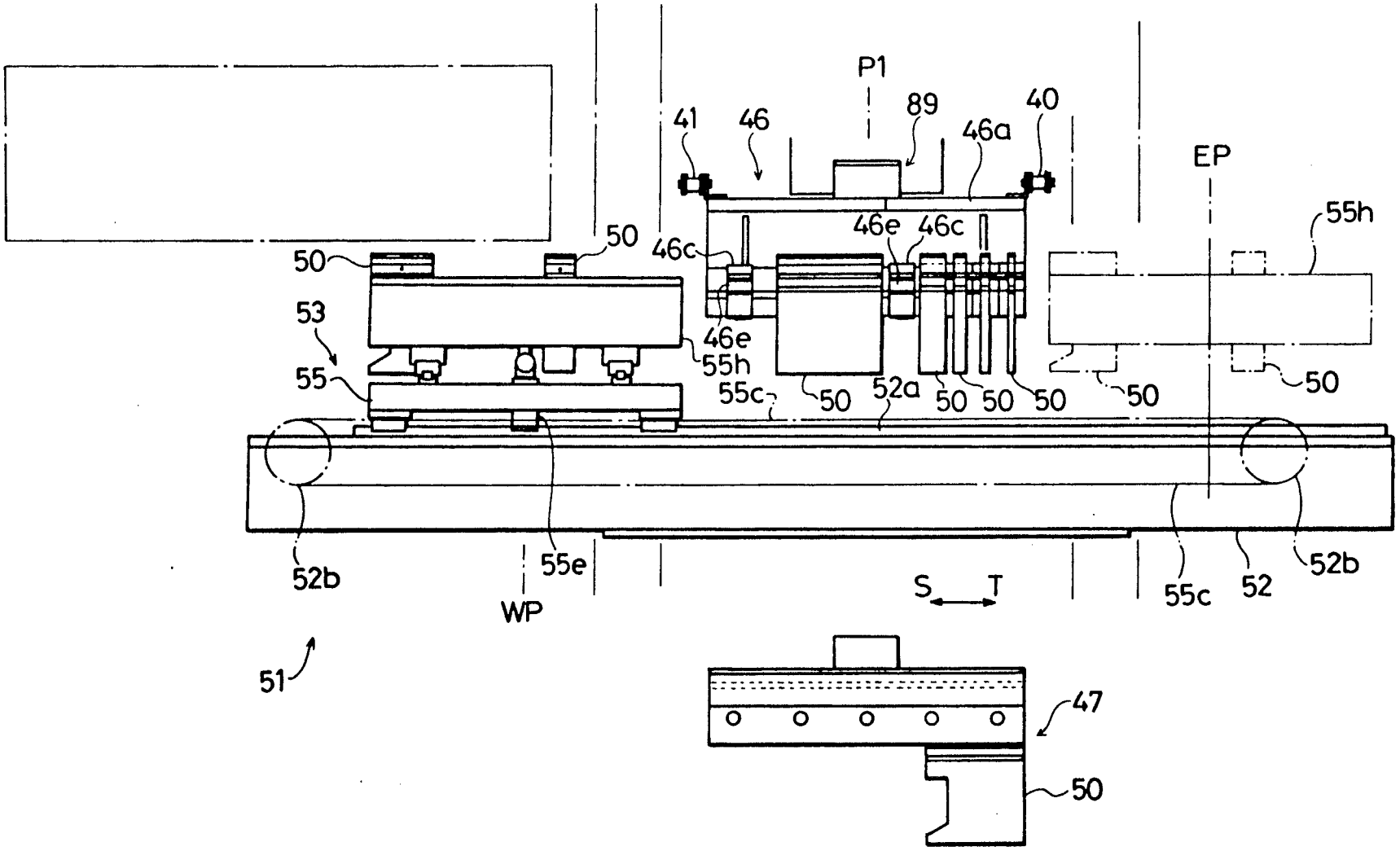
FIG. 6 is a front elevation of the die select station of FIG. 5.

On the other hand, at the right lower position in FIG. 2 of the chain carrying unit 37, that is, behind the press brake 1, a divisional die select station 51 is provided. The divisional die select station 51 has a frame 52 on which guiderails 52a are formed in the direction perpendicular to the chain running direction, as shown in FIG. 6. On the frame 52, a mobil station 53 is provided so as to be capable of being moved through the guiderails 52a in the directions of the arrows S and T. The mobil station 53 has a carriage 55 having straight bearings 55a at the lower face, which the straight bearings 55a are engaged with the guiderails 52a, as shown in FIG. 5. And, a timing belt 55c is provided on the frame 52 in the direction of movement of the mobil station 53, that is, in the directions of the arrows of S and T in FIG. 6 so as to extend having no end through pulleies 52b, 52b rotatably installed on the frame 52. A part of the timing belt 55c is fixed on and held with the carriage 55 by a clipper 55e of the left hand of FIG. 5 of the carriage 55. One of the pulleies 52b is connected with a driving motor 55b so as to be capable of being rotated and driven in normal and reverse directions. The carriage 55 can be properly moved L and driven along the guiderails 52a through the pulley 52b and the timing belt 55c in the directions of the arrows S and T in FIG. 6 by rotationing and driving the driving motor 55b in normal and reverse directions.

On the carriage 55, a bracket 55f is provided. On the bracket 55f, a plurality of driving cylinders 55g are disposed at proper intervals in the direction perpendicular to the paper face in FIG. 5. At the opposite side of the bracket 55f on the carriage 55, a slide block 55h is supported so as to be capable of being moved in the directions of the arrows J and K. A driving cylinder 55i is provided between the slide block 55h and the carriage 55 so as to be capable of moving and driving the slide block 55h in the directions of the arrows J and K. The slide block 55h is provided with a clamper 55j. The clamper 55j has a bracket 55k protruding in the left hand in the figure. At the top edge of the bracket 55k, an engagement portion 55m is formed. A hole 55n is formed corresponding to each divisional die 50 supported with the support unit 46 in the lower hand of the bracket 55k. In each hole 55n, a slider 55p is provided so as to be always energized owing to elasticity of a coiled spring 55q in the direction of the arrow M. And, at the top edge of the slider 55p, an engagement portion 55r is provided. A driving cylinder 55s is provided at the position of the slide block 55h, corresponding to each slider 55p.

And, the lower die storing unit 35 is provided in the lower hand of the upper die storing unit 33 in the figure, as shown in FIG. 2. The lower die storing unit 35 has a chain carrying unit 56. On this occasion, the constitution of the chain carrying unit 56 is almost similar to that of the chain carrying unit 36 of the upper die storing unit 33. Therefore, the same elements as those of the chain carrying unit 36 are marked with the same numerals, and the explanation of these elements will be omitted. With the chain carrying unit 56, die support units 57 are supported by well-known double chain at predetermined intervals of L4 in such a manner that their installation portions 57a always faces upward. Several sets of the unit lower dies 59 having face width of L6, which have a fixed length, are held with each die support unit 57, as shown in FIG. 21.

Figure 12:
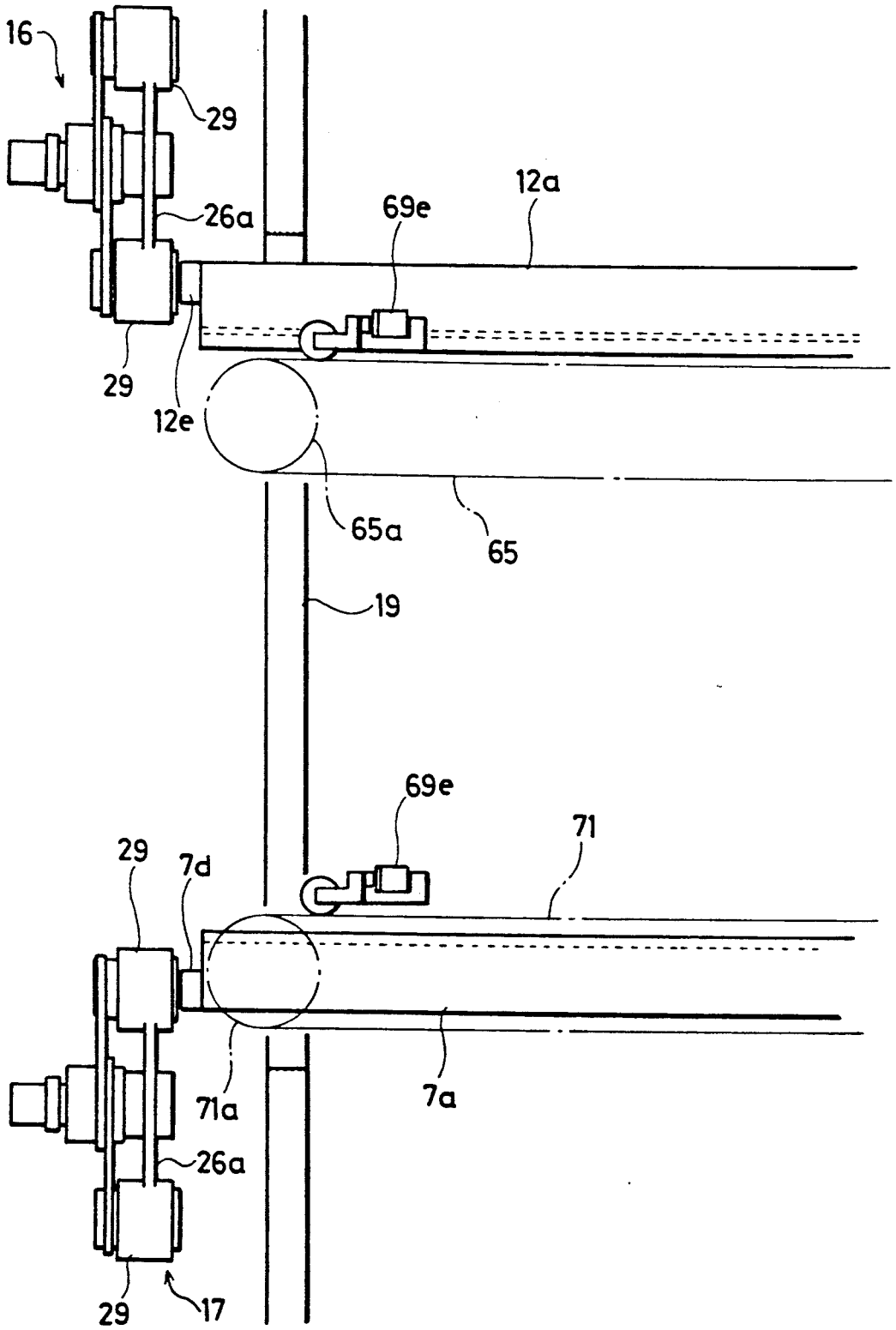
FIG. 12 shows an important feature of a die transfer device.
Figure 13:
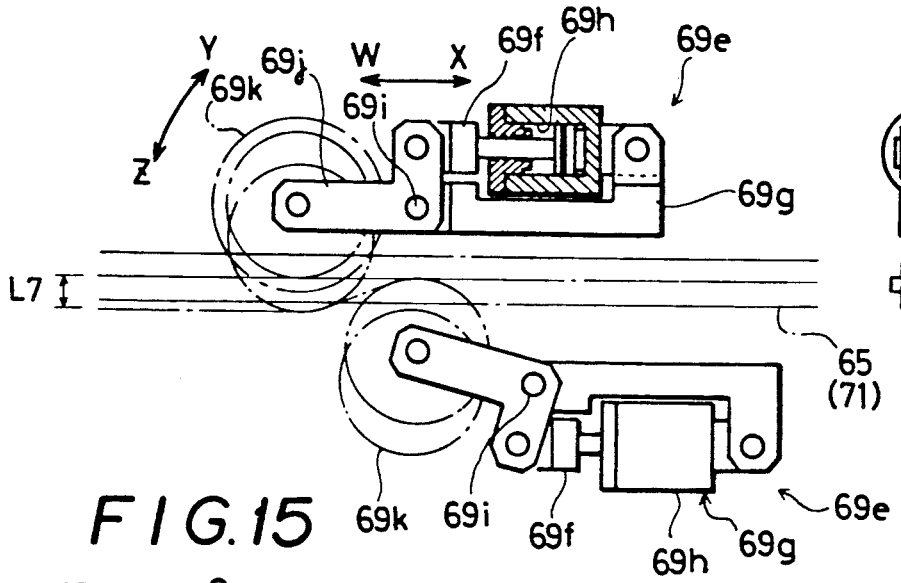
FIG. 13 shows shift cylinders.
Figure 14:
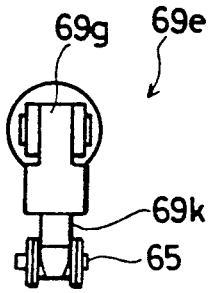
FIG. 14 is a side elevation of the shift cylinder.
Figure 16:
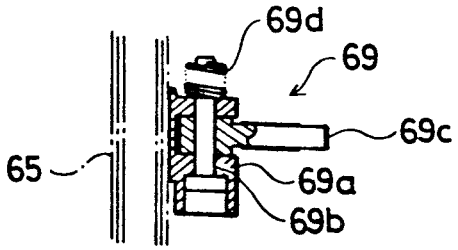
FIG. 16 is a top view of a transfer hook device.
Figure 17:
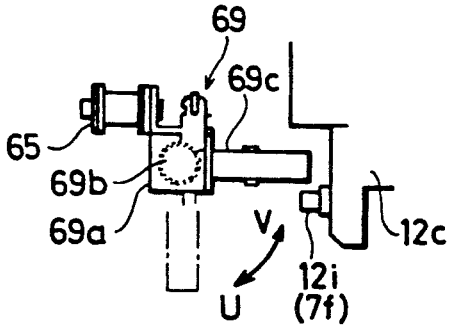
FIG. 17 is a front elevation of the transfer hook device.

And, a die transfer device 60 is provided between the die storing unit 31 and the automatic die exchange apparatus 15. The die transfer device 60 has an upper die transfer device 61 for transferring the upper die 13 between the upper die storing unit 33 and the upper die exchange apparatus 16 and a lower die transfer device 62 for transferring the lower die 11 between the lower die storing unit 35 and the lower die exchange apparatus 17. The upper die transfer device 61 has a frame 63 with which the upper body 5 of the press brake is provided, as shown in FIG. 2. A transfer chain 65 is provided between the left edge portion of the frame 63 in FIG. 12, that is, the left edge portion of the press brake 1 in FIG. 1 and the right edge portion of FIG. 3 of the chain carrying unit 37 of the upper die storing unit 33 so as to extend having no end through sprockets 65a, 65a and intersecting the press brake 1 and the die storing unit 31 in the directions of the arrows H and I in FIG. 1. Transfer hook devices 69 are provided on the chain 65 at predetermined intervals, as shown in FIG. 16 or 17. Each transfer hook device 69 has a main body 69a fixed on the chain 65. The main body 69a is provided with a hook 69c through a shaft 69b so as to be free to be moved and rotated in the directions of the arrows U and V. A torsion coiled spring 69d is provided between the hook 69c and the shaft 69b so as to always energize the hook 69c in the direction of the arrow V in FIG. 17. A plurality of shift cylinders 69e are provided at predetermined intervals in the directions of the arrows H and I on the upper side of FIG. 3 of the transfer chain 25. The shift cylinder 69e has a main body 69g fixed on the frame 63, as shown in FIG. 13 or 14. The main body 69g is provided with a cylinder 69h so as to be able to protrude and drive a rod 69f in the directions of the arrows W and X. At the top edge of the rod 69f, an arm 69j is installed. The arm 69j is mounted with the main body 69g through a pin 69i so as to be free to be moved and rotated in the directions of the arrows Y and Z. With the top edge of the arm 69j, a shift roller 69k is rotatably supported. The shift cylinders 69e are usually provided on both sides of the transfer chain 65 so as to pair, as shown in FIG. 13.

The lower die transfer device 62 has a frame 70 with which the lower body 3 of the press brake 1 is provided, as shown in FIG. 2. A transfer chain 71 is provided between the left edge portion of FIG. 12 of the frame 70, that is, the left edge portion of FIG. 1 of the press brake 1 and the right edge portion of FIG. 3 of the chain carrying unit 56 of the lower die storing unit 35 so as to extend through sprockets 71*a*, 71*a* having no end and intersecting the press brake 1 and the die storing unit 31 in the directions of the arrows H and I in FIG. 1. The transfer hook devices 69 are provided on the chain 71 at predetermined intervals as shown in FIG. 16 or 17, the same as the case of the chain 65. Furthermore, the shift cylinders 69*e* are usually provided at both sides of the transfer chain 71 so as to pair.

Figure 33:
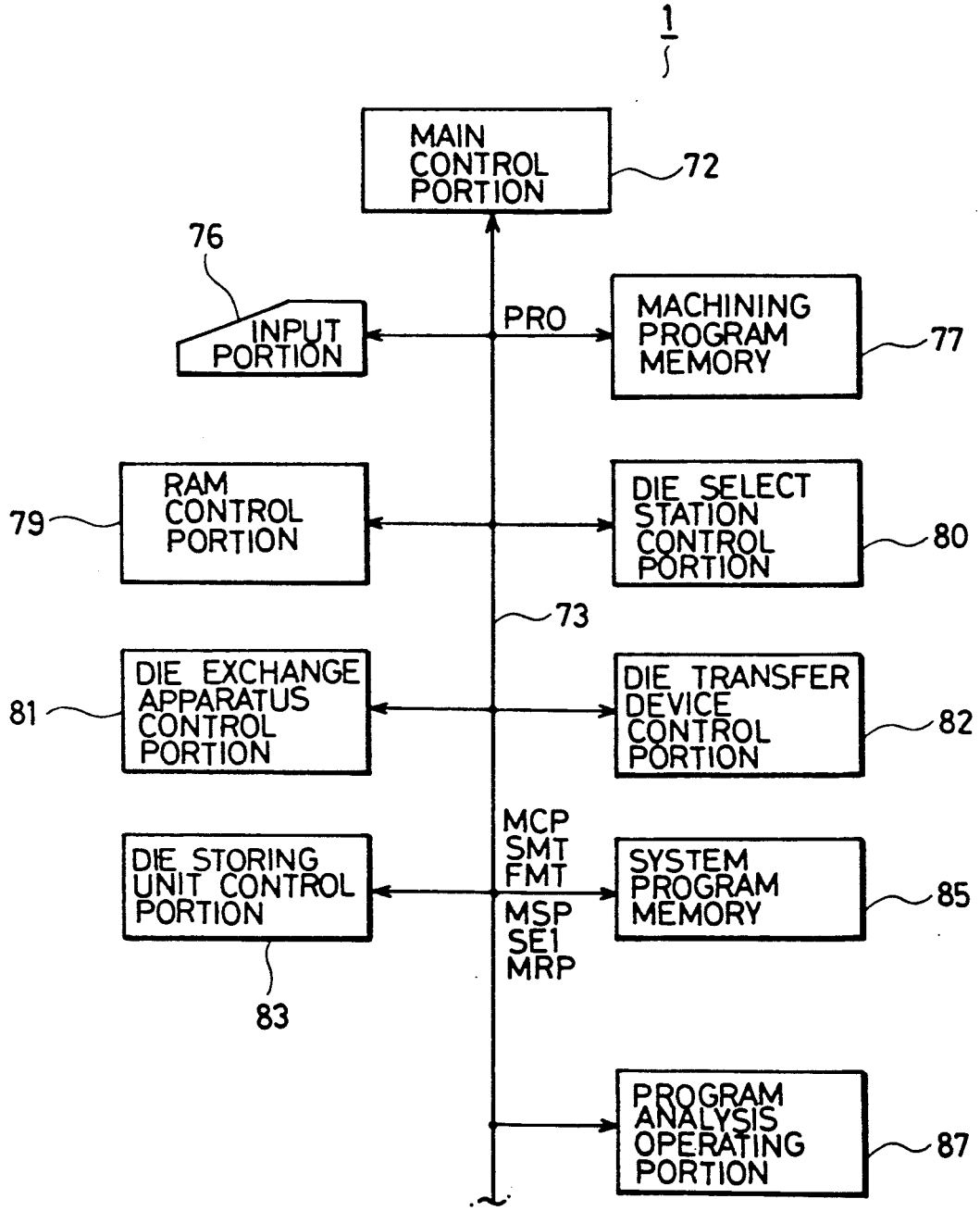
FIG. 33 is a control block diagram showing an example of a control system of the press brake.

A control system of the press brake 1 has a main control portion 72, as shown in FIG. 33. An input portion 76, such as a keyboard, a machining program memory 77, a ram control portion 79, a die select station control portion 80, a die exchange apparatus control portion 81, a die transfer device control portion 82, a die storing unit control portion 83, a system program memory 85, a program analysis operating portion 87 and the like are connected with the main control portion 72 through a bus line 73.

Figure 34:
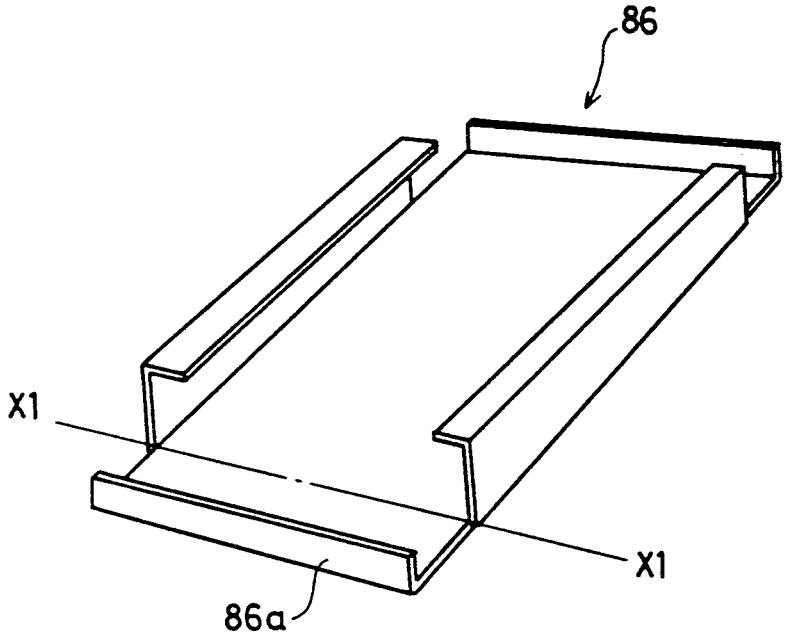
FIG. 34 is a perspective view showing a workpiece to be processed.

With the above-described constitution of the press brake 1, in order to execute folding machining on a workpiece 86 as shown in FIG. 34 about the line X1—X1 with the press brake 1, an operator commands the main control portion 72 to execute folding machining operation on the workpiece 86 through the input portion 76 as shown in FIG. 33. Then, the main cotrol portion 72 reads out a die supply program MSP from the system program memory 85 so as to combine and supply dies to be used for machining on the workpiece 86 according to the supply program MSP.

Figure 9:
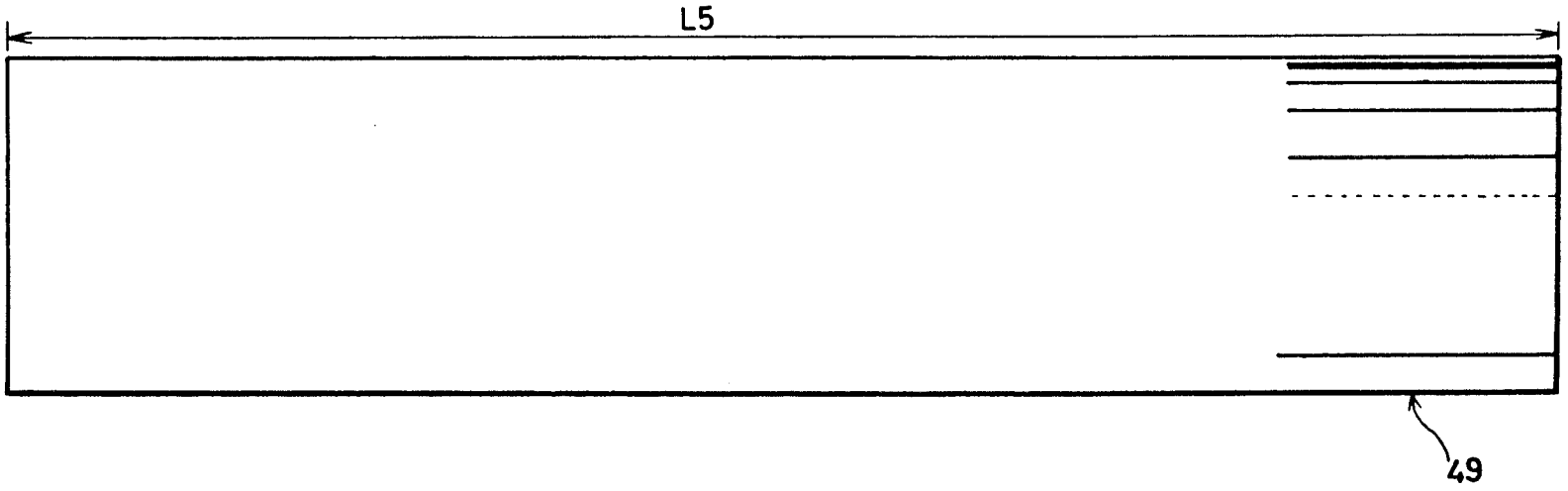
FIG. 9 is a front elevation showing an example of a standard length die.
Figure 10:
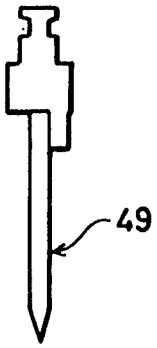
FIG. 10 is a side elevation of FIG. 9.
Figure 32:
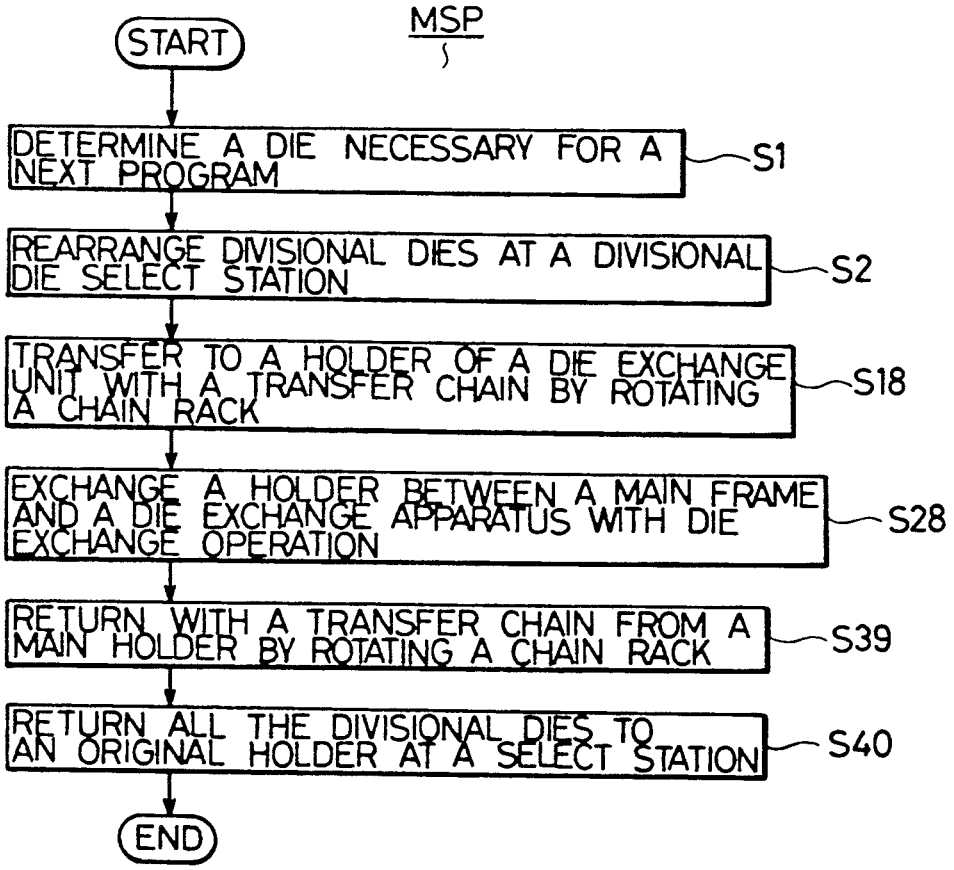
FIG. 32 is a flow chart showing an example of a die supply program.
Figure 35:
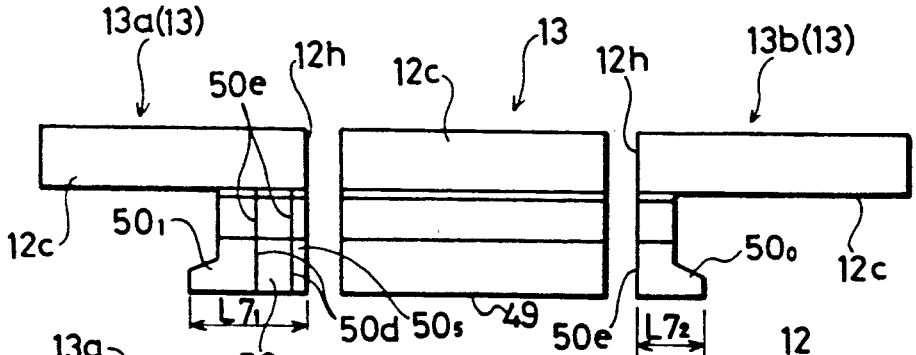
FIG. 35 shows a combination example of upper dies for machining the workpiece as shown in FIG. 34.
Figure 36:
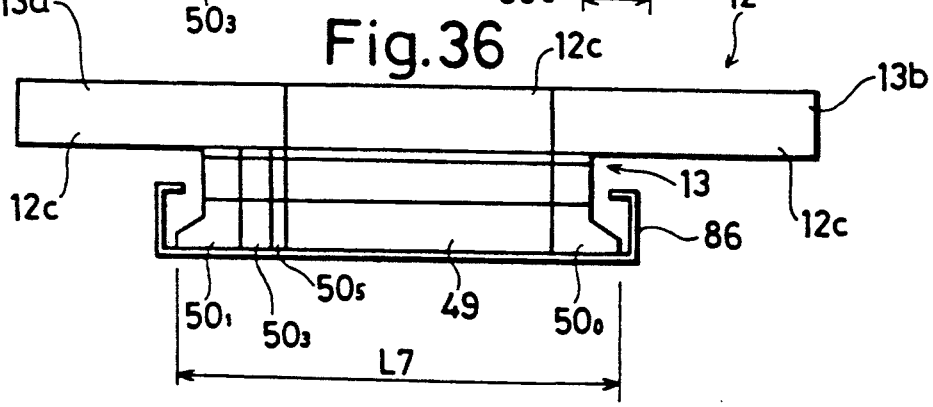
FIG. 36 shows the machining state of the workpiece of FIG. 34.

That is, the main control portion 72 commands the program analysis operating portion 87 to operate a combination of dies to be used for machining on the workpiece 86, according to its kind and its face width at the step of S1 of the supply program MSP as shown in FIG. 32. Receiving this, the program analysis operating portion 87 reads out a machining program PRO corresponding to the workpiece 86 from the machining program memory 77 so as to determine kinds of dies, such as a straight sword form and a goose neck form, and face width of dies, such as L7 (shown in FIG. 1), designated in the machining program PRO. In case of a workpiece as shown in FIG. 34, a so-called goose neck shaped die as shown in the left hand in FIG. 5, bend in the form of hook in its section, is designated in the machining program PRO as an upper die to be used for machining in order to prevent collision between a die and the edge portion 86*a* of the workpiece 86 at the time of folding machining. An combination of the upper dies to be used for machining is operated according to the face width of L7 of a die, designated in the program PRO. An upper die is the standard length upper die 49 as shown in FIG. 9, having a face width L5 of 835 mm, which length is standard, and the divisional upper die 50 as shown in FIG. 7 or 8, having the face width L5 smaller than that of the standard length die, as described before. A combination of the divisional dies 50 and the standard length die 49 is determined so as to be corresponded with the face width L7 of the die designated in the machining program PRO. On this occasion, the program analysis operating portion 87 selects the edge portion installation die $50_1$ and the divisional upper dies $50_3$ and $50_5$ among the divisional upper dies 50 as shown in FIG. 7, the standard length upper die 49 as shown in FIG. 9 and the edge portion installation die $50_0$ as shown in FIG. 8, as shown in FIG. 35 such that the face width of the upper die 13 is L7 when those dies are combined as shown in FIG. 36. When it is determined that a die to be used is goose neck form and the combination of the divisional upper dies 50 and the like comprising the upper die 13 is determined with the program analysis operating portion 87 in this way, the main control portion 72 proceeds to a step of S2 of the die supply program MSP and commands the die select station control portion 80 and the die storing unit control portion 83 to assemble partial upper dies 13*a*, 13*b*, respectively having face width of $L7_1$ and $L7_2$ as shown in FIG. 35, by properly combining the divisional upper dies 50 in the form of goose neck, operated and determined at the step of S1.

Figure 28:
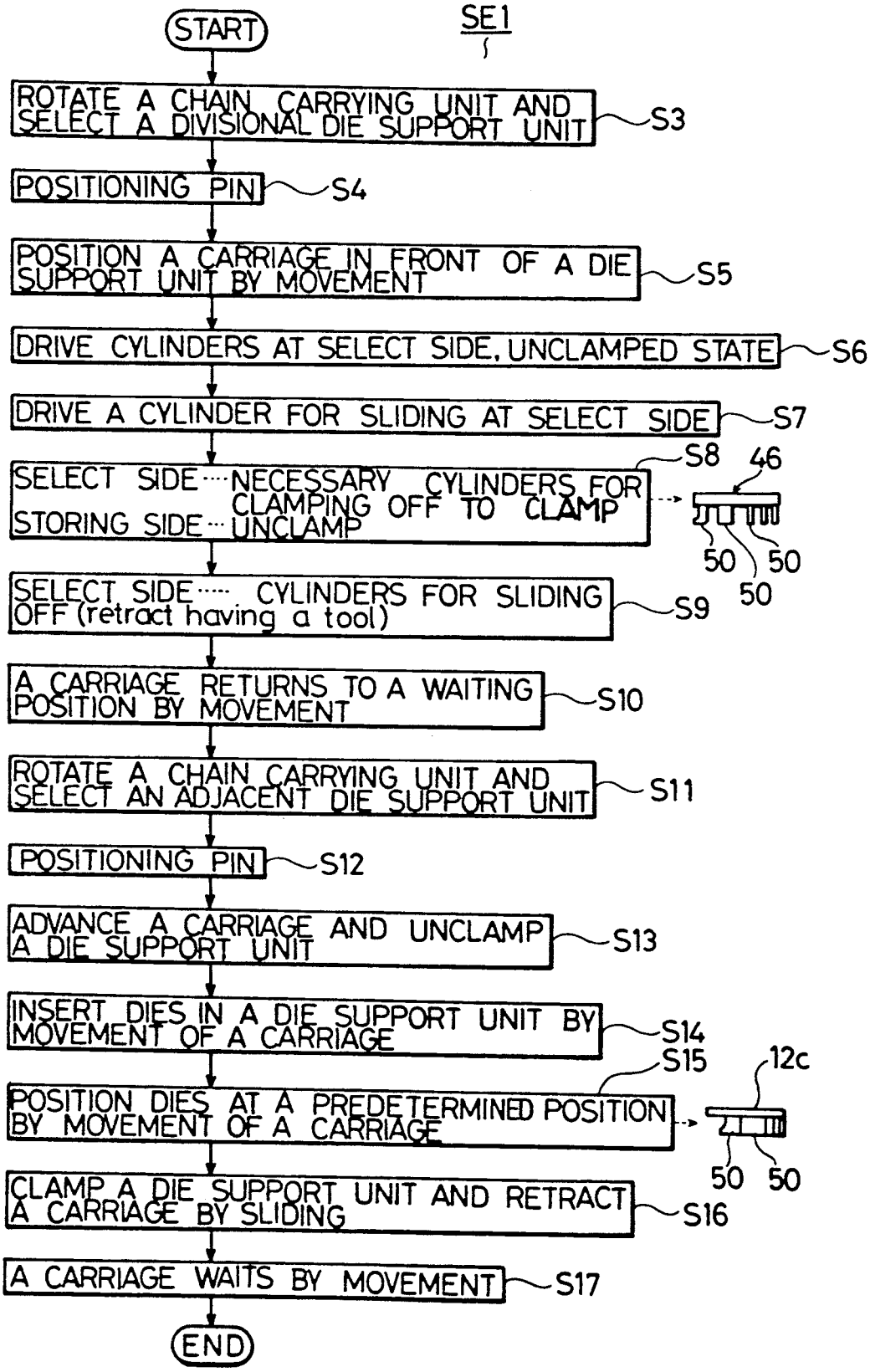
FIG. 28 is a flow chart showing an example of a die select program.

Receiving this, the die storing unit control portion 83 reads out a die select program SE1 as shown in FIG. 28 from the system program memory 85 and properly drives and rotates the chain carrying unit 37 of the upper die storing unit 33 through the sprockets 42 with the driving motor 34 in the directions of the arrows J and K in FIG. 1 and so as to position the divisional die support unit 46 supporting the divisional upper dies 50, having the form to be used for machining on a workpiece (that is, goose neck form), at a die supply position P1 of the divisional die select station 51 as shown in FIG. 5 at the step of S3. Since the carriage 55 of the divisional die select station 51 is positioned at a waiting position WP in the left hand of FIG. 6 on this occasion, the movement operation of the divisional die support unit 46 with the chain carrying unit 37 is smoothly performed without a collision between the carriage 55 and the divisional die support unit 46.

When the divisional die support unit 46 is positioned at the predetermined die supply position P1 in this way, the program proceeds to the step S4. The die storing unit control portion 83 drives a positioning pin unit 89 provided at the die supply position P1 as shown in FIG. 6 into the die support unit 46 so as to precisely position the die support unit 46 at the die supply position P1 and so as to hold. Next, the program proceeds to the step S5. The die select station control portion 80 drives and moves the carriage 55 through the timing belt 55*c* on the guiderails 52*a* in the right hand in FIG. 6. by driving and rotating the driving motor 55*b* of the die select station 51 as shown in FIG. 5 so as to position the slide block 55*h* on the carriage 55 at the position facing the die support unit 46 positioned at the die supply position P1, as shown in FIG. 5. When the slide block 55*h* faces the die support unit 46, the program proceeds to the step S6 and all the driving cylinders 55*s* at the side of the slide block 55*h* of the carriage 50 are driven. Then, a rod 55*u* of the driven driving cylinder 55*s* is driven and protruded in the direction of the arrow L in FIG. 5. And, its top edge abuts on the slider 55*p* of the slide block 55*h* such that the slider 55*p* rises against the coiled spring 55*q* in the direction of the arrow L. Then, the risen slider 55*p* is in such a state that its engagement portion 55*r* and the engagement portion 55*m* of the bracket 55*k* are close to each other, that is, in unclamped state.

Then, the die select program SE1 proceeds to the step S7 and the driving cylinder 55*i* is driven so as to move the slide block 55h in the direction of the arrow J, that is, at the side of the divisional die support unit 46 positioned at the die supply position P1. Then, the engagement portions 55m, 55r in unclamped state are fitted into the engagement groove 50b, formed at the side face of the holding portion 50a of each of the divisional dies 50 supported with the divisional die support unit 46. And, the only driving cylinders 55s corresponding to the edge portion installation die $50_1$, the divisional upper dies $50_3$ and $50_5$, designated at the time of die select among all the driving cylinders 55s in the driving state at the step S8 are stopped driving. At the same time, the only driving cylinders 55g corresponding to the edge portion installation die $50_1$, and the divisional upper dies $50_3$, $50_5$, designated at the time of die select among the driving cylinders 55g provided at the side of the divisional die support unit 46 of the carriage 50 are driven. Then, a rod 55t of the driving cylinder 55g is selectively driven in the direction of the arrow L. And, the engagement between the edge portion installation die $50_1$ and the divisional upper dies $50_3$, $50_5$ among the divisional dies as shown in FIG. 7 is released and those dies are in state of being capable of being detached in the direction of the arrow K in FIG. 5. That is, in this state, regarding the edge portion installation die $50_1$, the divisional upper dies $50_3$, $50_5$ in the divisional die support unit 46, the engagement in the support unit 46 side is released and the engagement in the slide block 55h side is maintained, so that the divisional dies 50 except the above-described ones still maintain the state of being supported at the side of the support unit 46. Next, the die select program SE1 proceeds to the step S9. The driving cylinder 55i is driven in the direction of the arrow K so as to move the slide block 55h in the direction of the arrow K. Then, only the edge portion installation die $50_1$, the divisional upper dies $50_3$, $50_5$, which engagement is released in the support unit 46 side, depart from the side of the support unit 46 so as to be transferred with the slide block 55h in the direction of arrow K.

When the divisional dies 50 comprising the partial upper die 13a are selected in this way, the program proceeds to the step 10. And, the carriage 55 is driven and moved in the direction of the arrow S in FIG. 6 so as to be returned at the predetermined waiting position WP in the left hand in the figure. Next, the program proceeds to the step 11. Then, the die storing unit control portion 83 drives the chain carrying unit 37 so as to drive and move the divisional die support unit 46 which has been positioned at the die supply position P1 up to that time, the distance L4 in the direction of the arrow J in FIG. 5 and the adjacent combination die support unit 47, provided corresponding to the support unit 46, is positioned at the die supply position P1 so as to be held and fixed with the positioning pin unit 89 in a similar way at the step 12. And, the program proceeds to the step S13. Then, the driving cylinder 55i is driven so as to be advanced the slide block 55h in the direction of the arrow J. And, an installation portions 50c formed on the holding portions 50a of the edge portion installation die $50_1$, divisional upper dies $50_3$, $50_5$ selected on the slide block 55h are aligned with a holding groove 12g of the subholder 12c supported with the positioned combination die support unit 47. And, an unclamp cylinder 90 provided at the die supply position P1 is driven so as to pressure the holding pin 12d of the subholder 12c in the direction of the arrow J. Then, the subholder 12c is in unclamped state.

In the foregoing state, the program proceeds to the step S14 and the carriage 55 is driven at a low speed in the direction of the arrow T in FIG. 6. Then, the installation portions 50c of the selected divisional upper dies 50 on the slide block 55h are gradually inserted in the holding groove 12g of the subholder 12c in the direction perpendicular to the paper face in FIG. 5. When the right side face of FIG. 35 of the die $50_5$ installed at the right position in FIG. 6 among the edge portion installation die $50_1$, the divisional upper dies $50_3$, $50_5$, held on the slide block 55h, corresponds with the right position of the subholder 12c, that is, a holder end face 12h in FIG. 35 in such a process that the divisional upper dies 50 held on the slide block 55h move in the holding groove 12g of the subholder 12c supported with the combination die support unit 47 in the right direction in FIG. 6, the driving cylinder 55s provided at the position corresponding to the divisional upper die $50_5$, that is, in the lower hand in FIG. 5, is driven so as to drive and protrude a rod 55u in the direction of the arrow L. Then, the rod 55u abuts on the slider 55p supporting the divisional upper die $50_5$ so as to move the slider 55p in the direction of the arrow L. And, the engagement relation between the engagement portion 55r of the slider 55p and the engagement groove 50b of the divisional upper die $50_5$ is released and the divisional upper die $50_5$ remains in the subholder 12c such that its right end face corresponds with the holder end face 12h. The carriage 55 remaining the divisional upper die $50_5$ in the subholder 12c still continues to be driven and moved in the direction of the arrow T in FIG. 6. Then, the divisional upper die $50_3$ which is in the state of being supported with the right hand of FIG. 6 of the slide block $55_h$ approaches a left side face 50e of FIG. 35 of the divisional upper die $50_5$ transferred to the subholder 12c while the divisional upper die $50_5$ is transferred to the subholder 12c. When the right side face 50d of FIG. 35 of the divisional upper die $50_3$ abuts on the left side face 50e of FIG. 35 of the divisional upper die $50_5$, the die select station control portion 80 drives the driving cylinder 55s, provided at the position corresponding to the divisional upper die $50_3$, that is, the lower hand in FIG. 5, so as to drive and protrude the rod 55u in the direction of the arrow L. Then, the rod 55u abuts on the slider 55p supporting the divisional upper die $50_3$ so as to move the slider 55p in the direction of the arrow L and the engagement relation between the engagement portion 55r of the slider 55p and the engagement groove 50b of the divisional upper die $50_3$ is released. Then, the divisional upper die $50_3$ remains in the subholder 12c such that its right end face 50d abuts on the left side face 50e of the divisional upper die $50_5$. The carriage 55 detaining the divisional upper dies $50_5$, $50_3$ in the subholder 12c still continues to be driven and moved in the direction of the arrow T in FIG. 6. Then, the edge portion installation die $50_1$, which is in the state of being supported with the right hand of FIG. 6 of the slide block 55h approaches the left side face 50e of FIG. 35 of the divisional upper die $50_3$ transferred to the subholer 12c while the divisional upper dies $50_5$, $50_3$ are transferred to the subholder 12c. When the right side face 50d of FIG. 35 of the edge portion installation die $50_1$ abuts on the left side face 50e of FIG. 35 of the divisional upper die $50_3$, the die select station control portion 80 drives the driving cylinder 55s, provided at the position corresponding to the edge portion installation die $50_1$ so as to drive and protrude the rod 55u in the direction of the arrow L. And, the engagement relation between the engagement portion 55r of the slider 55p and the engagement groove 50b of the edge portion installation die $50_1$ is released and the edge portion installation die $50_1$ remains in the subholder 12c such that its right end face abuts on the left side face 50e of the divisional upper die $50_3$. The carriage 55 detaining the divisional upper dies $50_5$, $50_3$ and the edge portion installation die $50_1$ in the subholder 12c still continues to be driven and moved in the direction of the arrow T in FIG. 6 and is driven till it reaches a retreating position EP in the right hand in FIG. 6.

When the carriage 55 reaches the retreating position EP in this way, the die select program SE1 proceeds to the step S16. Then, the driving of the unclamp cylinder 90 is released so as to hold the divisional upper dies $50_5$, $50_3$ and the edge portion installation die $50_1$, which transfer finished, with the subholder 12c. Then, the divisional upper dies $50_5$, $50_3$ and the edge portion installation die $50_1$ adhere to one another in the subholder 12c as shown in FIG. 35 so as to form the partial upper die 13a having the face width of $L7_1$. In the foregoing state, the driving cylinder 55i of the carriage 55 of the divisional die select station 51 is driven and the slide block 55h is retracted in the direction of the arrow K in FIG. 5 so as to be positioned at the position a predetermined distance away in the right hand in FIG. 5 from the combination die support unit 47, positioned at the die supply position P1. In this state, the program proceeds to the step S17. Then, the carriage 55 is driven and moved in the direction of the arrow S in FIG. 6 again so as to be returned to the waiting position WP in the left hand in the figure from the retreating position EP. When the partial upper die 13a comprising the left edge portion of FIG. 35 of the upper die 13 is assembled in this way, a partial upper die 13b as shown in FIG. 35, comprising the right edge portion of the upper die 13, will now be assembled in a similar way. This assembly operation is executed in the divisional die select station 51 in a similar way to the case of the partial upper die 13a. The divisional die support unit 46 holding the edge portion installation die $50_0$, as shown in FIG. 8, is positioned at the die supply position P1 of the divisional die select station 51. In the foregoing state, the edge portion installation die $50_0$ is transferred to the slide block 55h of the carriage 55. Furthermore, the transferred edge portion installation die $50_0$ is installed in the adjacent combination die support unit 47 corresponding to the divisional die support unit 46 such that the left end face 12h of the subholder 12c corresponds with the left side face 50e of the edge portion installation die $50_0$, as shown in FIG. 35. Then, the partial upper die 13b as shown in FIG. 35 is assembled.

When the partial upper dies 13a, 13b comprising the upper die 13, as shown in FIG. 35, are assembled in the combination die support units 47, 47 in this way, the main control portion 72 proceeds to the step S18 of the die supply program MSP as shown in FIG. 32 and commands the die storing unit control portion 83 and the die transfer device control portion 82 to supply the upper die exchange apparatus 16 of the automatic die exchange apparatus 15 with the partial upper dies 13a, 13b and the standard length upper die 49 and to supply the lower die exchange apparatus 17 with unit lower dies 59. The installation number of the unit lower die 59 is obtained by the operation of the program analysis operating portion 87 such that the lower die 11 to be used for machining has the face width of L8 of a die as shown in FIG. 1, which is not short in comparison with the face width of L7 designated in the machining program PRO according to the face width of L7. Since the lower die 11 serves only receiving of the workpiece 86 at the time of machining on the workpiece 86, machining importance to the face width of L8 is lower in comparison with the face width of L7 of the upper die 13, so that it is available that the face width of L8 is longer than the face width of L7 of the upper die 13.

Figure 23:
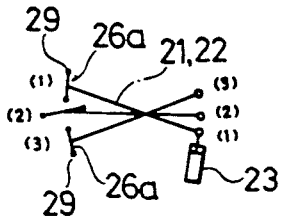
FIG. 23 shows the movement of the die exchange apparatus.
Figure 30:
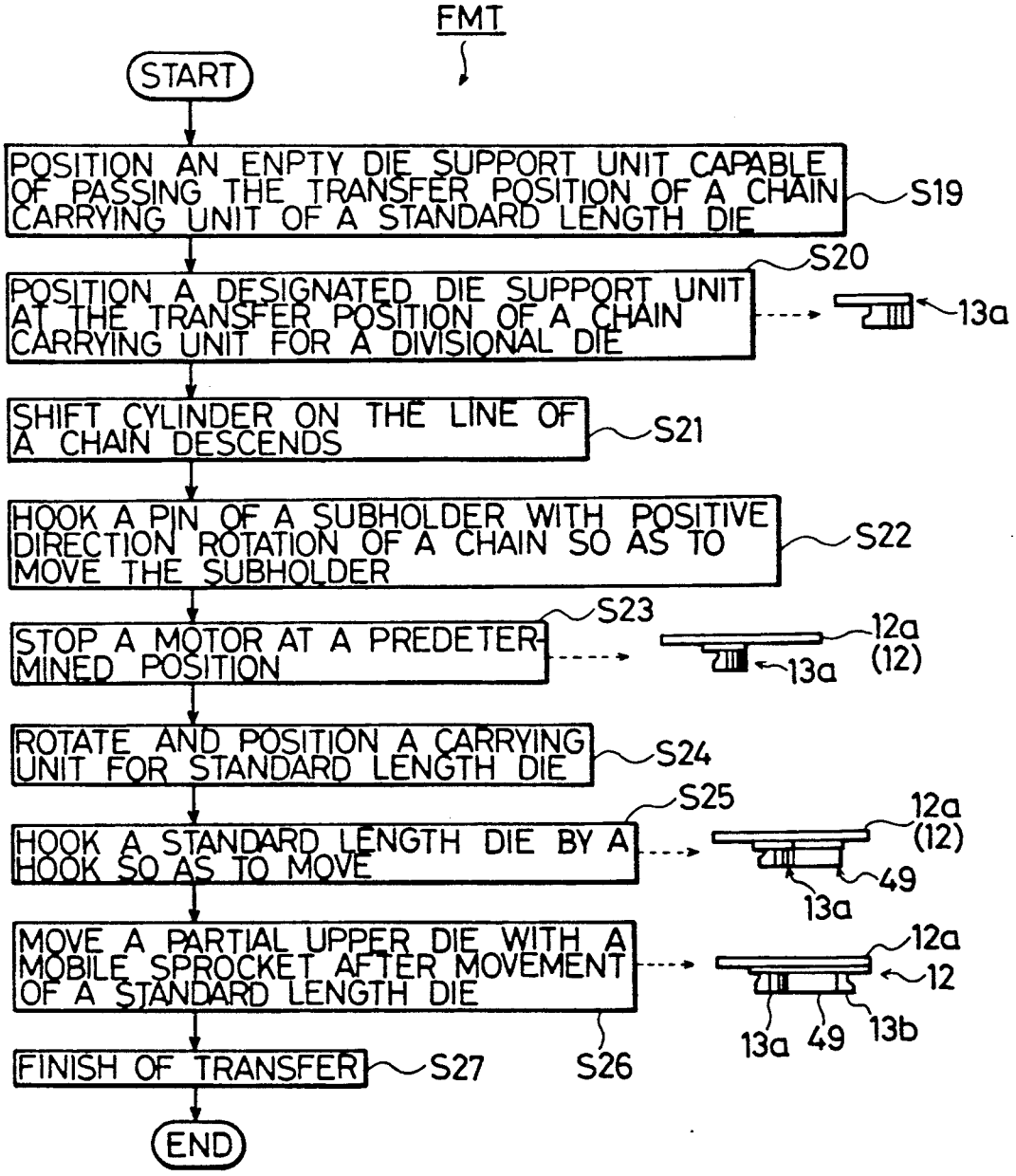
FIG. 30 is a flow chart showing an example of a first die transfer program.

The transfer operation of the upper die 13 from the upper die storing unit 33 of the die storing unit 31 to the upper die exchange apparatus 16 of the automatic die exchange apparatus 15 is executed according to a first die transfer program FMT (stored in the system program memory 85) as shown in FIG. 30. Prior to this transfer operation, the main control portion 72 commands the die exchange apparatus control portion 81 to drive the upper die exchange apparatus 16 of the automatic die exchange apparatus 15 and to position the arms 21, 22 at the predetermined waiting positions. The upper die exchange apparatus 16 is positioned at three positions: a waiting position (1), a die exchange position (2), the die reversal position (3), by the driving cylinder 23, as shown in FIG. 23. At the waiting position (1), the upper die 13 is transferred between the die storing unit 33. At the die exchage position (2), an upper die is exchanged between the upper die support unit 9 of the press brake 1. And, at the die reversal position (3), the subarms 26a are reversed 180°. That is, the upper die exchange apparatus 16 is positioned at the waiting position (1).

Next, the die storing unit control portion 83 drives a driving motor 38 as shown in FIG. 1, of the chain carrying unit 36, storing the standard length upper die 49, and drives and moves empty die support unit 45, which isn't loaded with the standard length upper die 49, in the directions of the arrows K and L so as to be positioned at a die transfer position P2 as shown in FIG. 2, corresponding to the above-described waiting position (1) of the upper die exchange apparatus 16 at the step S19 of the first die transfer program FMT. Next, the program proceeds to the step S20 and the combination die support unit 47 holding the partial upper die 13a at the side of the chain carrying unit 37, assembled a little while ago, is positioned at the die transfer position P2 in a similar way. Then, the empty die support unit 45 at the side of the chain carrying unit 36, the combination die support unit 47 at the side of the chain carrying unit 37, holding the partial upper die 13a and the upper die holder 12 held between the holders 29, 29 of the upper die exchange apparatus 16, in which an upper die hasn't been inserted yet, are aligned in the directions of the arrows H and I in the figure at the transfer position P2, as shown in FIG. 3.

In the foregoing state, the program proceeds to the step S21. The die transfer device control portion 82 drives a pair of shift cylinders 69e, 69e at the right position in FIG. 3 of the combination die support unit 47 among a plurality of shift cylinders 69e of the upper die transfer device 61 and drives the shift cylinders 69e provided at the position corresponding to the position at which the partial upper die 13a of the upper die holder 12 is to be installed. The rods 69f of the shift cylinders 69e, 69e at the side of the combination die support unit 47 is protruded in the direction of the arrow W in the figure as shown in FIG. 13 and the rod 69f of the shift cylinder 69e above the transfer chain 65 at the side of the upper die exchange apparatus 16 is also protruded in the direction of the arrow W. Then, the transfer chain 65 is shifted by the shift roller 69k at the left hand side in FIG. 13, that is, shifted a distance L7 in the lower hand in the figure at the side of the upper die exchange apparatus 16. As a whole, the transfer chain 65 is shifted the distance L7 in the lower hand between the combination die support unit 47 and the position at which the partial upper die 13a of the upper die holder 12 supported with the exchange apparatus 16 is to be installed, as shown in FIG. 25.

Figure 25:
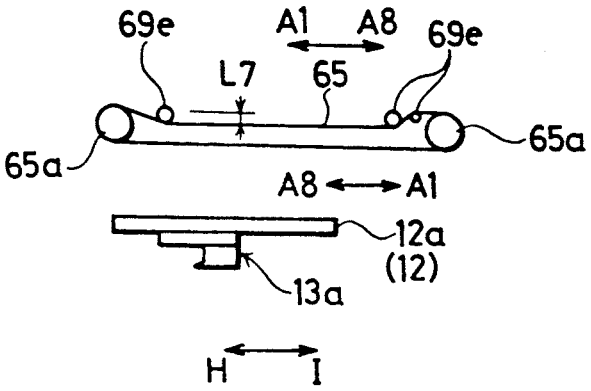
FIGS. 25 through 27 show the shifting state of a chain at the time of die movement.

In the foregoing state, the first die transfer program FMT proceeds to the step S22 and the transfer chain 65 is rotated in the direction of the arrow A1 in FIG. 25, that is, in a positive direction. Then, the hook 69c of the transfer hook device 69 installed in the transfer chain 65 is moved together with the transfer chain 65 in the direction of A1. On this occasion, in such an usual state that the transfer chain 65 isn't shifted in the lower hand, between the hook 69c and the die support unit 45 or the combination die support unit 47, their phases are shifted in the upper and lower directions, as shown in FIG. 17. Therefore, the both don't abut on and engage with each other with the chain 65 rotating. In such a state that the transfer chain 65 is shifted in the lower hand, the hook 69c abuts on and engages with an engagement projection 12i, provided on the subholder 12c supported with the die support units 45, 47. Accordingly, in such a state that the transfer chain 65 is shifted as shown in FIG. 25, the hook 69c of the transfer hook device 69 is shifted together with the chain 65 at the right hand of FIG. 3 of the chain carrying unit 37 in the lower direction. Then, the engagement projection 12i of the subholder 12c holding the partial upper die 13a, being held with the combination die support unit 47 positioned at the die transfer position P2 of the carrying unit 37 abuts on and engages with the hook 69c of the transfer hook device 69. And, the subholder 12c starts to move in the direction of the arrow A1 in FIG. 3 for the combination die support unit 47 by the hook 69c, moving together with the chain 65 in the direction of A1. On this occasion, since the lock device 47c of the combination die support unit 47 as shown in FIG. 15 is released at the die transfer position P2, the subholder 12c smoothly moves for the support unit 47 in the direction of the arrow A1.

The subholder 12c starting to move by the hook 69c passes in the empty die support unit 45 positioned at the die transfer position P2 of the chain carrying unit 36 and furthermore, is inserted in the holding groove 12b of the upper die holder 12 supported with the upper die exchange apparatus 16. The subholder 12c inserted in the upper die holder 12 moves in the further left hand in FIG. 25 by the hook 69c. The position of the hook 69c, that is, the position in the upper die holder 12 of the subholder 12c is always operated and detected as movement amount of the chain 65 with the die transfer device control portion 82. Accordingly, when the die transfer device control portion 82 determines that the hook 69c reaches the position at which the subholder 12c is to be set, the first die transfer program FMT proceeds to the step S23 and a driving motor driving the transfer chain 65 is stopped. Then, the subholder 12c installing the partial upper die 13a is positioned at a predetermined position in the upper die holder 12 as shown in FIG. 25. In the foregoing state, the driving shift cylinder 69e, which was in driving state up to that time, is released. Then, the shifting state of the transfer chain 65 of the distance L7 in the lower hand in FIG. 25 is released. And, the chain 65 moves returning the distance L7 in the upper hand in FIG. 17. At the same time, the hook 69c of the transfer hook device 69 also moves in the upper hand in the figure and the engaging state of the hook 69c and the subholder 12c, which were in abutting and engaging state up to that time, is released. On this occasion, a plurality of transfer rollers 12j are provided in the holding groove 12b of the upper die holder 12 in the direction perpendicular to the paper face so as to be capable of being rolled and moved, as shown in FIG. 20. Furthermore, since the clamping of the clamp cylinder 12k is released at the time of insertion of the subholder 12c, the insertion setting operation of the subholder 12c in the upper die holder 12 is smoothly performed.

Figure 26:
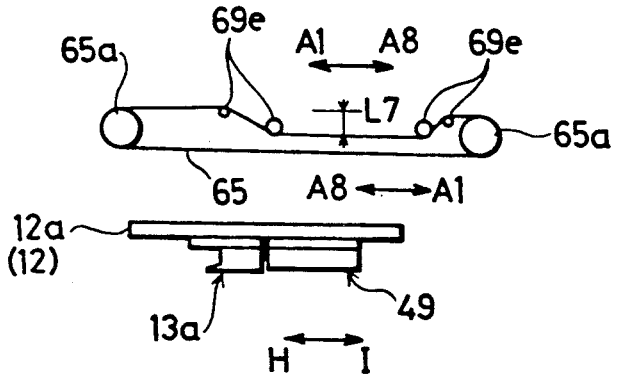

When the setting the partial upper die 13a on the upper die holder 12 finishes in this way, the first die transfer program FMT proceeds to the step S24. Then, the die storing unit control portion 83 drives the chain carrying unit 36 so as to position the die support unit 45 installing the standard length upper die 49 to be used for machining, at the predetermined die transfer position P2. When the standard length upper die 49 is positioned at the die transfer position P2, the program proceeds to the step S25. Then, in a similar way to the case of the partial upper die 13a, the shift cylinders 69e corresponding to the positions at which the chain carrying unit 36 and the standard length upper die 49 are to be set are driven so as to shift the transfer chain 65 between the shift cylinders 69e, the distance L7 in the lower hand in the figure, as shown in FIG. 26. And, the transfer chain 65 is driven in the direction of the arrow A1 again. When the hook 69c of the transfer hook device 69 passes the die transfer position P2 of the chain carrying unit 37, providing the combination die support unit 47, the chain 65 is in the upper hand of FIG. 17 of the engagement projection 12i of the upper die holder 12 supported with the support unit 47. Therefore, the hook 69c passes without abutting on and engaging with the engagement projection 12i of the subholder 12c of the combination die support unit 47 positioned at the die transfer position P2, and when the hook 69c reaches in the lower hand of FIG. 3 of the chain transfer device 36, it is shifted together with the chain 65 in the lower direction by the shift cylinders 69e. Then, the engagement projection 12i of the subholder 12c of the standard length upper die 49 positioned at the die transfer position P2 of the chain carrying unit 37 abuts on and engages with the hook 69c and the subholder 12c installing the standard length upper die 49 is transferred to the side of the main holder 12a of the upper die exchange apparatus 16 in a similar way to the above-described case. When the subholder 12c supporting the standard length upper die 49 abuts on the right end face of FIG. 26 of the subholder 12c supporting the partial upper dies 13a which are set on the main holder 12a supported with the upper die exchange apparatus 16, the transfer chain 65 is stopped driving and the shift cylinders 69e are stopped driving so as to move the chain 65 in the upper hand in the figure. Then, the engagement relation between the engagement projection 12i of the subholder 12c supporting the standard length upper die 49 transferred in the main holder 12a and the hook 69c is released. Then, the divisional upper die 13a and the standard length upper die 49 are set in the main holder 12a of the upper die exchange apparatus 16 so as to link, as shown in FIG. 26.

When the divisional upper die 13a and the standard length upper die 49 are set in the main holder 12a in this way, the first die transfer program FMT proceeds to the step S26. Then, the combination die support unit 47 holding the partial upper die 13*b* at the side of the chain carrying unit 37, which was assembled a little while ago, is positioned at the die transfer position P2 in a similar way. Then, the die support unit 45 empty by transferring the standard length upper die 49 at the side of the chain carrying unit 36, the combination die support unit 47 holding the partial upper die 13*b* at the side of the chain carrying unit 37 and the main holder 12*a* in which the standard length upper die 49 and the partial upper die 13*a* are inserted and aligned at the transfer position P2 in the directions of the arrows H and I in the figure, as shown in FIG. 3.

Figure 27:
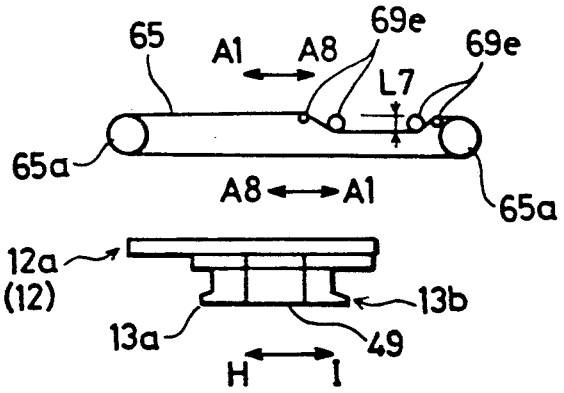

In the foregoing state, a pair of shift cylinders 69*e*, 69*e* in the right position of the combination die support unit 47 of FIG. 3 among the shift cylinders 69*e* are driven and the shift cylinders 69*e* provided at the position corresponding to the position at which the partial upper die 13*b* of the main holder 12*a* is to be installed, is driven such that the transfer chain 65 shifts the distance L7 in the lower direction between the combination die support unit 47 and the position at which the partial upper die 13*b* of the upper die holder 12 is to be installed, as a whole, as shown in FIG. 27.

In the foregoing state, the transfer chain 65 is rotated in the direction of A1 in FIG. 27, that is, in a positive direction. Then, the hook 69*c* of the transfer hook device 69 installed in the transfer chain 65 moves together with the transfer chain 65 in the direction of the arrow A1 and abuts on and engages with the engagement projection 12*i* of the subholder 12*c* holding the partial upper die 13*b*, supported with the combination die support unit 47 positioned at the die transfer position P2 of the carrying unit 37 so as to move the partial upper die 13*b* in such a position that it is connected with the standard length upper die 49 in the main holder 12*a* held with the exchange apparatus 16. When the partial upper die 13*b* is connected with the standard length upper die 49, movement operation by the transfer chain 65 is stopped and the shifting state of the chain 65 is released. Then, the transfer operation finishes at the step S27 in FIG. 30.

With respect to the lower die exchange apparatus 17 of the automatic die exchange apparatus 15, operations are executed in a similar way to the upper die exchange apparatus 16. That is, the die support unit 57 installing the unit lower die 59 is positioned at a predetermined die exchange position P3 of the chain carrying unit 56, as shown in FIG. 2. A predetermined number of the unit lower dies 59 are inserted in the empty main holder 7*a* of the lower die exchange apparatus 17 together with the subholder 7*b* with the transfer chain 71 and the shift cylinder 69*e*. The lower die exchange apparatus 17 is similar to the upper die exchange apparatus 16 as shown in FIG. 23, exclusive of such a point that their waiting positions and reversal positions are respectively opposite to each other in the upper and lower directions. Accordingly, with respect to the insertion setting of the unit lower dies 59 into the main holder 7*a*, the driving cylinder 23 of the lower die exchange apparatus 17 is driven and protruded in the direction of the arrow A2 in FIG. 2 such that the arms 21, 22 are in the state as shown in FIG. 23 (3). In the foregoing state, the holders 29, 29 in which the empty main holder 7*a* among the subarms 26*a*, 26*a* vertically held is installed, are positioned at the die exchange position P3 so as to perform exchange operations.

When the upper dies 13 to be used for machining are set in the upper die exchange apparatus 16 as shown in FIG. 27 and the lower dies 11 to be used for machining are set in the lower die exchange apparatus 17 in this way, the clamped cylinders 12*k*, 7*c* of the respective main holders 12*a*, 7*a*, held with the exchange apparatus 16, 17 are driven so as to fix and hold the dies 13, 11 with the main holders 12*a*, 7*a*. Next, the main control portion 72 proceeds to the step S28 of the die supply program MSP as shown in FIG. 32. Then, the upper die holder 12 and the lower die holder 7 which finish the setting of dies and being held with the exchange apparatus 16, 17, respectively, and the upper die holder 12 and the lower die holder 7 respectively installing the upper die 13 and the lower die 11 installed in the press brake 1, to be exchaned, are exchanged by the die exchange operation according to the following processes.

Figure 24:
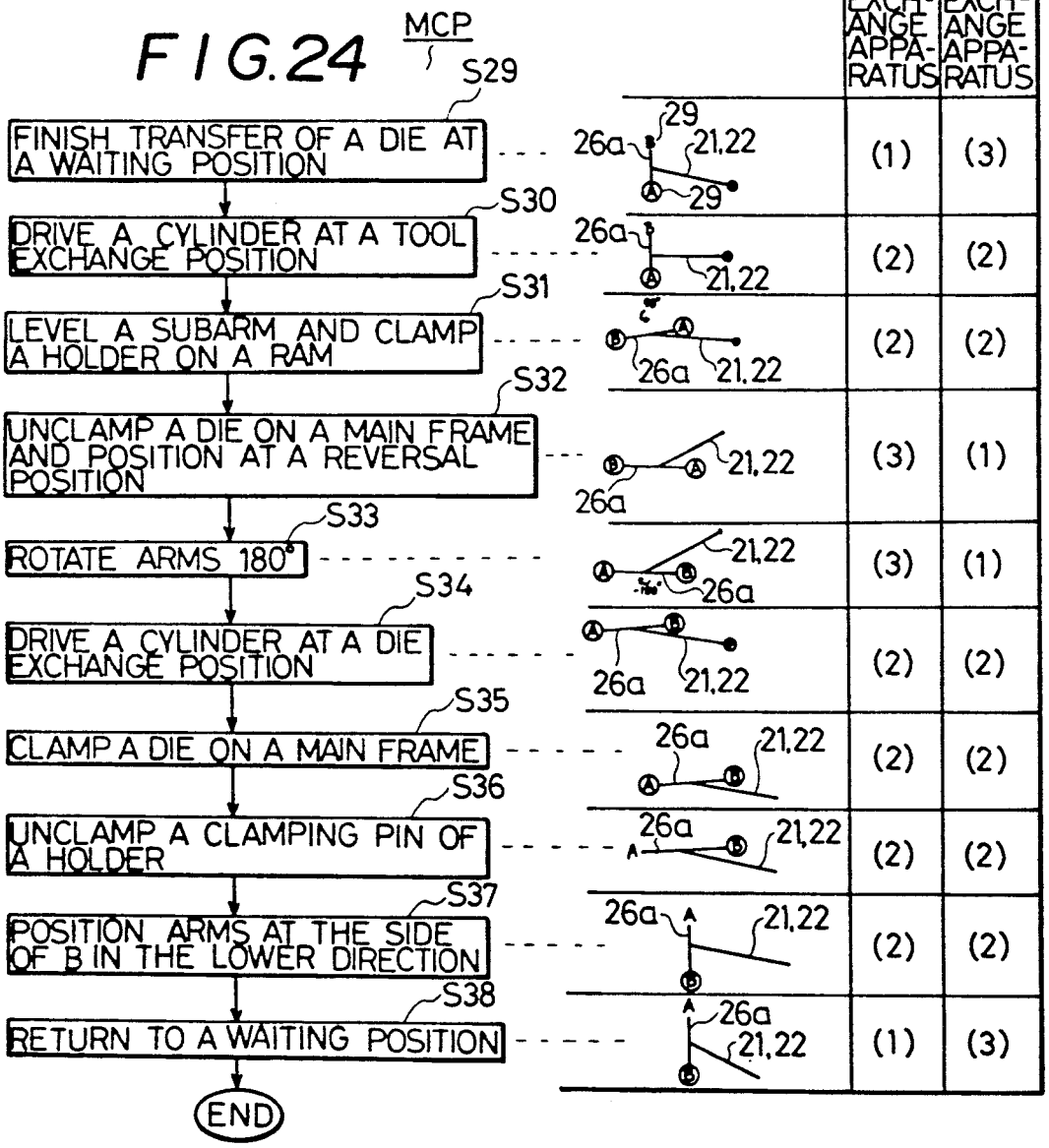
FIG. 24 is a flow chart showing an example of a die exchange control program and a view showing the state of the die exchange apparatus in each step.

That is, the main control portion 72 reads out a die exchange control program MCP from the system program memory 85 and commands the die exchange apparatus control portion 81 to execute die exchange operation for the side of the press brake 1 according to the program MCP. The die exchange apparatus control portion 81 determines whether the transfer of the dies 13, 11 to the main holders 12*a*, 7*a* held with the die exchange apparatus 16, 17 finishes at the step S29 of the die exchange control program MCP as shown in FIG. 24. When the finish of the transfer is determined, the program proceeds to the step S30. Then, the driving cylinders 23 of the exchange apparatus 16, 17 are driven. In case of the upper die exchange apparatus 16, the ram 23*a* is protruded and driven in the direction of the arrow A3 in FIG. 2. And, in case of the lower die exchange apparatus 17, the ram 23*a* is retracted and driven in the direction of the arrow A4 in FIG. 2. Then, the arms 21, 22 as shown in FIG. 4 are leveled so as to be positioned at the tool exchange position. Hereinafter, explanations of only upper die exchange apparatus 16 will now be given. The state of the respective exchange apparatus 16, 17 is shown corresponding to the numbers (1)–(3) in FIG. 23, in the right hand of FIG. 24, and redundant explanations will be omitted.

When the arms 21, 22 are positioned at the tool exchange position at the step S30 of the die exchange control program MCP, the program proceeds to the step S31. Then, the subarm 26*a* is rotated 90° so as to position the subarm 26*a* on which the holders 29, 29 with not holding the upper die holder 12 are installed, at the position facing the holder supporter 12*e* of the side face of the upper die holder 12 held with the upper die support unit 9 of the press brake 1, to be exchanged, as shown in FIG. 21. (On this occasion, two pairs of holders 29 are respectively denoted as A, B for convenience of explanations, and the holders 29 holding the upper die holder 12 among those holders 29 are marked with .)

In order to do so, the driving motor 30 as shown in FIG. 4 is rotated predetermined degrees in a predetermined direction. Then, the rotation of the motor 30 is transferred to the shaft 25 supported with the arm 21 in the left hand in FIG. 4 through the output shaft 30*a* with the gear 20*c* and the timing belt 29*e*, and in a similar way, transferred to the shaft 25 held with the arm 22 in the right hand in FIG. 4 through the output shaft 30*a* and the second hollow shaft 20*b* with the gear 20*c* and the timing belt 29*e* so as to rotate the respective shafts 25 90° in the direction of the arrow A5. Then, the subarm 26 fixed on the sleeve 26 with the rotation of the shafts 25, 25 also rotates in the direction of the arrow A5 so as to position the holder 29 in the upper hand in FIG. 24, which doesn't hold the upper die holder 12, at the side face of the upper die holder 12 at the side of the press brake 1 as shown in FIG. 21.

When the subarm 26 is positioned to be horizontal in this way, the holding pins 29*a* of the holder 29 at the side of the press brake 1 are protruded at the side of the holder 12, as shown in FIG. 21 or 22 in such that the holding pins 29*a* engage with the holder supporter 12*e*. Then, the upper die holding holder 12 is held with both sides of the holders 29, 29 as shown in FIG. 4. In the foregoing state, the program proceeds to the step S32 in FIG. 24. The driving cylinder 9*d* of the upper die support unit 9 at the side of the press brake 1 is driven so as to move and rotate the clamper 9*c* in the direction of the arrow G in FIG. 20. Then, the holding of the upper die holder 12 with the clamper 9*c* is released. The upper die holder 12 is in the state of being capable of being pulled in the direction of the arrow C. In the forgoing state, the driving cylinder 23 of the upper die exchange apparatus 16 is driven so as to move and rotate the arms 21, 22 about the driving shaft 20 in the direction of the arrow A6 in FIG. 2 and so as to be positioned at a predetermined reversal position. On this occasion, the holder 12 held with the holders 29, 29 is held such that the rotational cylinder 29*d* providing the holding pin 29*a* is rotatable about the holder 29*f* and so as to always have constant form owing to the timing belt 29*c*. Therefore, the holder 12 is supported such that dies always face the lower hand in FIG. 4 while the subarm 26 rotates.

Next, the program proceeds to the step S33. The subarm 26*a* is rotated 180° through the driving motor 30 so as to position the upper die holder 12 in which the upper die was set a little while ago, in the lower hand of the upper die support unit 9 of the press brake 1 and so as to position the detached die holder 12 behind the main body 2. In the foregoing state, the program proceeds to the step S34. The driving cylinder 23 is driven again so as to return the arms 21, 22 to being horizontal state. Then, the upper die holder 12 positioned in the lower hand of the upper die support unit 9 owing to reversal of the subarm 26*a* is engaged with the holding groove 9*b* in unclamped state so as to insert the upper portion of the main holder 12*a* from the lower hand in the figure as shown in FIG. 20. Then, the program proceeds to the step S35 in FIG. 24. The driving cylinder 9*d* is driven so as to move and rotate the clamper 9*c* in the direction of the arrow F. Then, the upper die holder 12 is certainly held in the holding groove 9*b*. In this state, the program proceeds to the step S36. The holding pins 29*a* of the holder 29 holding the upper die holder 12 are retracted in the direction of the arrow I in FIG. 21 and the holding state of the upper die holder 12 with the holder 29 is released.

When newly set upper die 13 is set in the press brake 1 in this way, the program proceeds to the step S37. The driving motor 30 is driven so as to position the upper die holder 12, which was detached from the side of the press brake 1 a little while ago, in the lower hand of the arms 21, 22. Furthermore, in the foregoing state, the driving cylinder 23 is driven so as to move and rotate the arms 21, 22 in the direction of the arrow A7 in FIG. 2 and so as to be positioned at the predetermined waiting position, as shown at the step S38. In this state, the exchanged upper die holder 12 is positioned at the transfer position P2, aligning with the upper die storing unit 33 in the directions of the arrows H and I as shown in FIG. 3. This state means preparation for next returning operations of dies to the die storing unit 33.

The above-described die exchange operations are executed in a similar way with respect to the lower die exchange apparatus 17, as described before. In case of detaching the lower die holder 7 from the lower die support unit 6, the clamped cylinder 6*b* is driven so as to release the engagement between the base 6*a* and the main holder 7*a*, and in this state, the holder 7 is moved with the exchange apparatus 17 in the direction of the arrow B. Installation is executed according to opposite operations to detachment.

When the dies for processing on the workpiece 86 as shown in FIG. 34 are installed in the press brake 1 in this way, the corresponding machining program PRO is read out from the machining program memory 77 and the ram 5*a* is driven and moved through the ram control portion 79 according to the machining program PRO in the directions of the arrows B and C in FIG. 20 so as to execute the predetermined machining on the workpiece 86.

Figure 31:
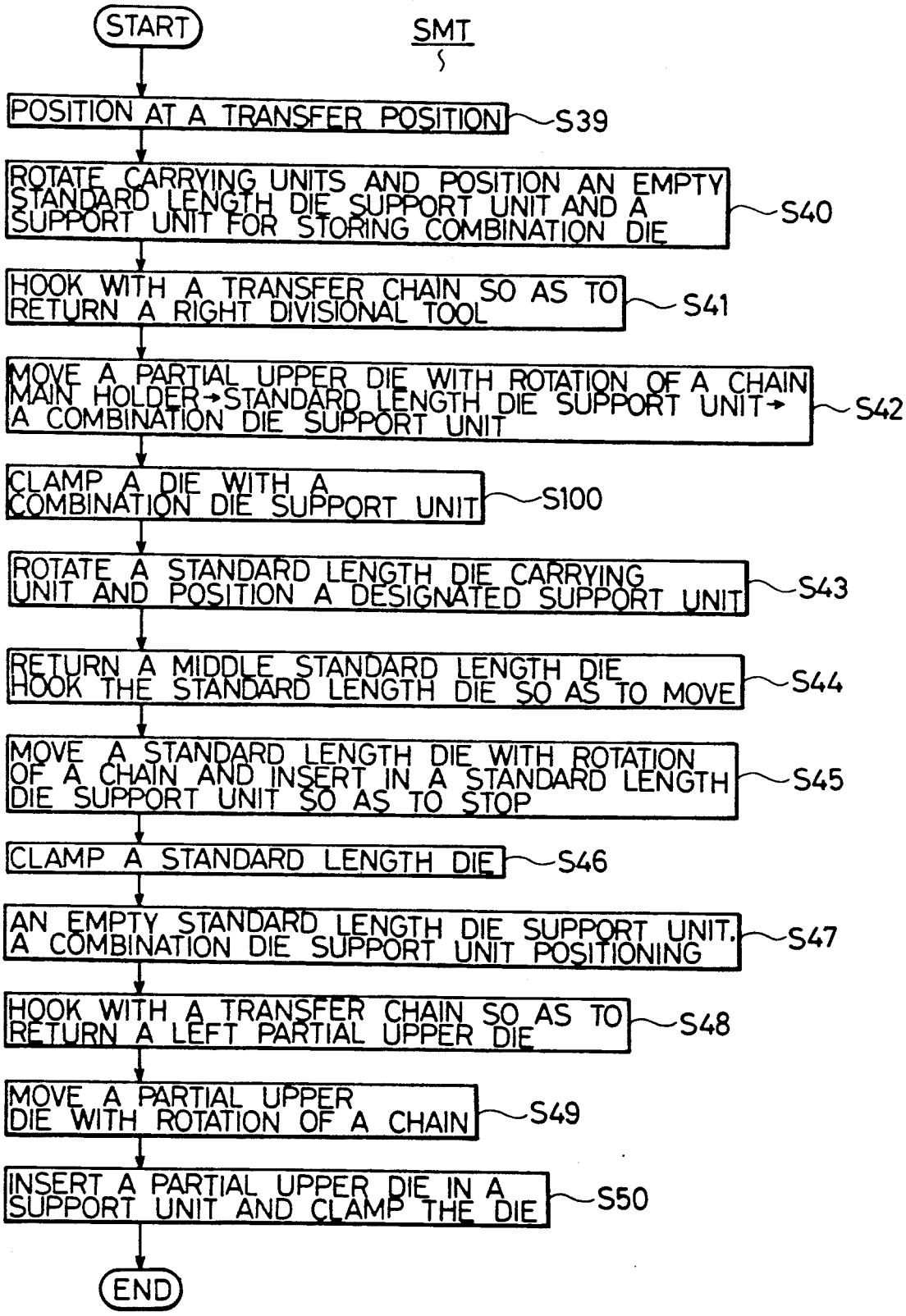
FIG. 31 is a flow chart showing an example of a second die transfer program.

On the other hand, it is necessary that the standard length upper die 49, the divisional upper die 50, the unit lower die 59, installed in the upper die holder 12 and the lower die holder 7, detached from the press brake 1, are returned to and stored in the upper die storing unit 33 and the lower die storing unit 35, respectively. This operation is executed at the step S39 of the die supply program MSP as shown in FIG. 32. At the step S39, a second die transfer program SMT as shown in FIG. 31 is read out from the system program memory 85 and this operation is executed with the die transfer device control portion 82 and the die storing unit control portion 83. The second die transfer program SMT shows almost opposite operations to the first die transfer program FMT as shown in FIG. 30. At the step S39, the holders 29, 29 holding the upper die holder 12 holding the dies which are to be stored in the upper die storing unit 33 are positioned at the predetermined transfer position P2. Next, the chain carrying unit 37 is driven so as to position the combination die support unit 47 storing the partial upper die 13*b* installed in the right end portion of FIG. 36 of the upper die 13 held with the upper die holder 12, at the predetermined transfer position P2 and the carrying unit 36 is driven so as to position the empty die support unit 45 for passing a partial upper die to the side of the carrying unit 37, at the transfer position P2.

In the foregoing state, the program proceeds to the steps 41, 42. Then, the shift cylinder 69*e* of the upper die transfer device 61 is properly driven so as to shift the transfer chain 65 between the partial upper die 13*b* of the upper die holder 12 positioned at the transfer position P2 and the carrying unit 37, the distance L1 in the lower hand in the figure, as shown in FIG. 27. In the foregoing state, the transfer chain 65 is rotated and driven in the direction of the arrow A8 so as to store the partial upper die 13*b* in the groove 47*b* of the predetermined combination die support unit 47 of the carrying unit 37 with the transfer hook device 69 through the empty die support unit 45 of the carrying unit 36 from the side of the main holder 12*a*. When the partial upper die 13*b* is stored in the groove 47*b* of the predetermined combination die support unit 47 of the carrying unit 37, the program proceeds to the step S100. The lock device 47*c* as shown in FIG. 15 is driven so as to fix and hold the partial upper die 13*b* in the groove 47*b* together with the subholder 12*c*. On this occasion, an auxiliary rails 91 are provided among the main holder 12a of the transfer position P2 and the carrying units 36, 37, as shown in FIG. 3. Therefore, the subholder 12c smoothly moves among the upper die exchange apparatus 16 and the carrying units 36, 37 without falling down.

When the partial upper die 13b is stored in the chain carrying unit 37, the program proceeds to the step S43 through step S46 so as to execute storing operation of the standard length upper die 49 in the main holder 12a. In order to do so, the carrying unit 36 is driven so as to position the die support unit 45 storing the standard length upper die 49 at the predetermined transfer position P2. At the step S44, as shown in FIG. 26, the transfer chain 36 between the standard length upper die 49 in the main holder 12a, to be transferred, and the die support unit 45 of the transfer position P2 of the carrying unit 36 is shifted the distance L7 in the lower hand of the figure. In the foregoing state, the chain 65 is driven in the direction of the arrow A8 so as to transfer the standard length upper die 49 in the main holder 12a, in the die support unit 45 of the carrying unit 36 with the transfer hook device 69 and so as to be fixed and held with the support unit 45. Since the die support unit 45 is also provided with a lock device of the subholder 12c, similar to one as shown in FIG. 15, the standard length upper die 49 is held with the die support unit 45 without difficulties.

Next, the second die transfer program SMT proceeds to the step S47 as shown in FIG. 31. Then, the chain carrying unit 37 is driven so as to position the combination die support unit 46 storing the partial upper die 13a installed in the right end portion of FIG. 36 of the upper dies 13, which remain in the upper die holder 12, at the predetermined transfer position P2 and the carrying unit 36 is driven so as to position the empty die support unit 45 for passing a partial upper die to the side of the carrying unit 37, at the transfer position P2.

In the foregoing state, the program proceeds to the steps S48 and S49. The shift cylinder 69e of the upper die transfer device 61 is properly driven so as to shift the chain 65 between the partial upper die 13a of the upper die holder 12 positioned at the transfer position P2 and the carrying unit 37, the distance L7 in the lower hand in the figure, as shown in FIG. 25. In the foregoing state, the transfer chain 65 is driven and rotated in the direction of the arrow A8 so as to store the partial upper die 13a in the groove 47b of the predetermined combination die support unit 47 of the carrying unit 37 with the transfer hook device 69 through the empty die support unit 45 of the carrying unit 36 from the side of the main holder 12a. When the partial upper die 13a is stored in the groove 47b of the predetermined combination die support unit 47 of the carrying unit 37, the program proceeds to the step S50. Then, the lock device 47c as shown in FIG. 15 is driven so as to fix and hold the partial upper die 13a together with the subholder 12c in the groove 47b.

In this way, the upper die 13 held in the main holder 12a of the upper die exchange apparatus 16 of the automatic die exchange apparatus 15 is stored in the upper die storing unit 33. At the same time, the lower die 11 held with the exchanged lower die holder 7 held with the lower die exchange apparatus 17 is also stored in the predetermined die support unit 59 in the lower die storing unit 35 with the lower die transfer device 62 according to the same operations. Since the lower die 11 comprises unit lower dies having the same size, its transfer operation is almost the same as that of the standard length upper die 49 of the upper die, and the explanation of the operation will be omitted.

The respective partial upper dies 13a, 13b, which are exchanged from the press brake 1 and stored at the side of the chain carrying unit 37 of the upper die storing unit 33, are returned as the divisional upper die 50 comprising the partial upper dies 13a, 13b from the combination die support unit 47 to the divisional die support unit 46 at the die select station 51 at the step S40 of the die supply program MSP as shown in FIG. 32 so as to finish the execution of the die supply program MSP. That is, the main control portion 72 reads out a die return program MRP from the system program memory 85 for the execution of the step S40 and controls the return of the divisional upper dies 50 to respective divisional die support units 46 toward the die select station control portion 80 according to the program MRP.

Figure 29:
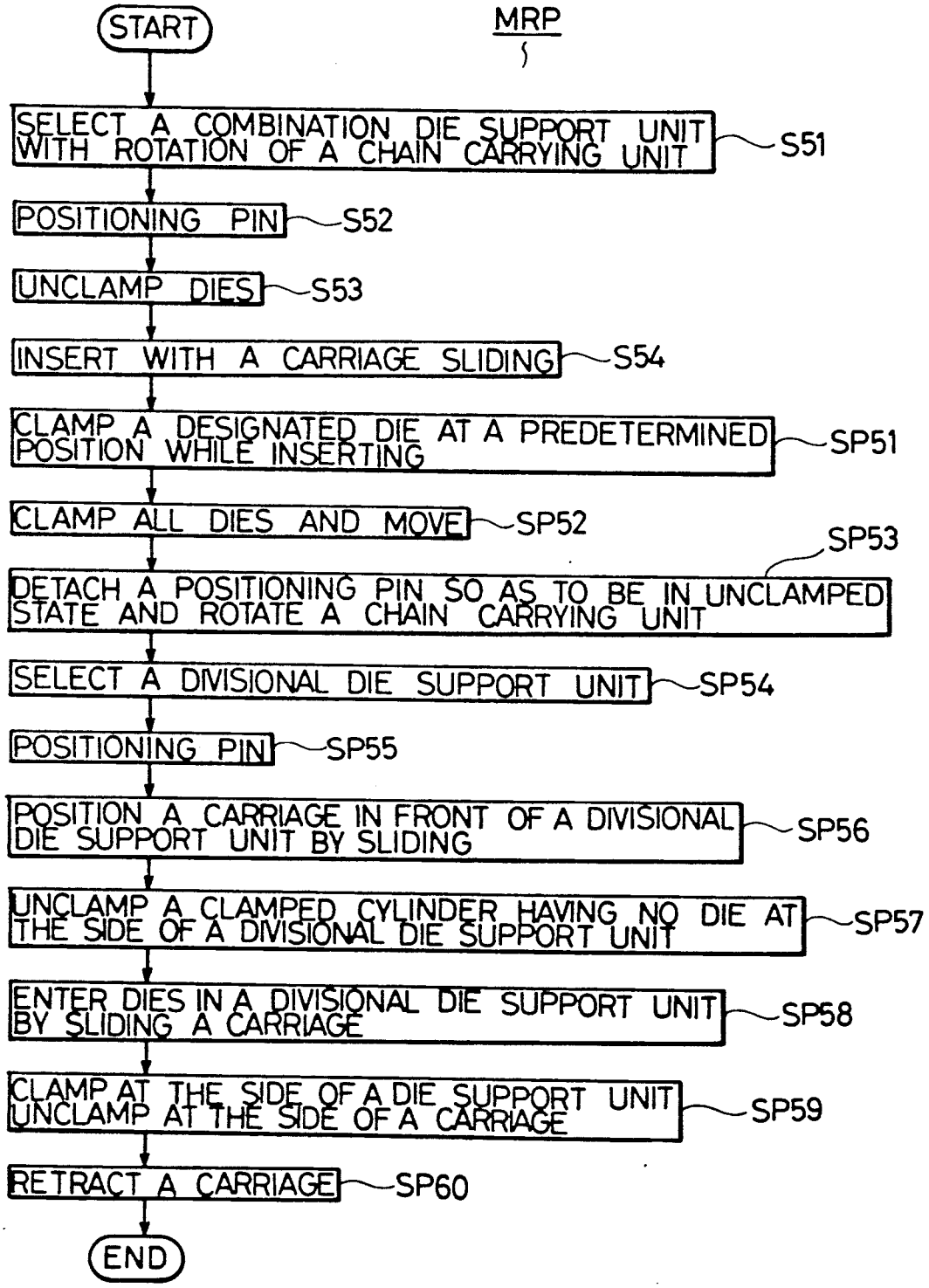
FIG. 29 is a flow chart showing an example of a die return program.

That is, the die return program MRP drives the chain carrying unit 37 so as to position the combination die support unit 47 supporting the partial upper dies 13a to be returned, at the die supply position P1 as shown in FIG. 5 at the step S51 as shown in FIG. 29, and fixes and holds with the positioning pin unit 89 as shown in FIG. 6 at the step S52. Next, the program proceeds to the step S53. The unclamped cylinder 90 as shown in FIG. 5 is driven so as to release the holding state of each divisional die 50 in the support unit 47. And, the program proceeds to the step S54. Then, the driving cylinder 55i is driven such that the slide block 55h is advanced in the direction of the arrow J. And, the engagement portion 55r and 55m of the slide block 55h are aligned with the engagement grooves 50b provided at the holding portions 50a of the edge portion installation die $50_1$ and the divisional upper dies $50_3$, $50_5$, which comprise the partial upper die 13a, in the die support unit 47. And, the driving cylinders 55s of the slide block 55h are driven such that all the sliders 55p rise in the direction of the arrow L, so as to be in unclamped state.

In the foregoing state, the carriage 55 is moved in the direction of the arrow T in FIG. 6 at a low speed. Then, the engagement portions 55r, 55m of the top edge of the slide block 55h, in unclamped state, are inserted in the engagement grooves 50b of the divisional dies 50 held with the subholder 12 in the direction perpendicular to the paper face in FIG. 5.

Next, the program proceeds to the step SP51 in FIG. 29. When the slider 55p with which the edge portion installation die $50_1$ and the divisional upper dies $50_3$, $50_5$ in the subholder 12 are to be held respectively, passes in the engagement groove 50b of the corresponding divisional upper die 50 in such a process that the engagement portions 55r, 55m of the slide block 55h move in the engagement grooves 50b of the divisional upper dies 50 held with the subholder 12 in the right direction of FIG. 6, the driving cylinder 55s is selectively driven so as to retract the rod 55u in the direction of the arrow M. Then, the slider 55p of the retracted rod 55u moves in the direction of the arrow M owing to elasticity of the coiled spring 55q so as to engage with the engagement groove 50b of the corresponding divisional upper die 50 and the engagement portion 55r of the slider 55p. And, the divisional upper die 50 is held on the slide block 55h with the engagement portions 55r, 55m. Since the slide block 55h is controlled so as to hold the divisional upper dies 50 in the state as shown in FIG. 7 in the same order and at the same intervals as the case of supporting the divisional upper dies 50 with the divisional die support unit 46 (but, so as to be symmetrical arrangement in mirror image, as shown in FIG. 5), the edge portion installation die $50_1$ and the divisional upper dies $50_3$, $50_5$ are held on the slide block 55*h* in the form as shown in FIG. 6 such that this arrangement contrasts with the arrangement of installing in the divisional die support unit 46. The carriage 55 holding the divisional upper dies $50_5$, $50_3$ and the edge portion installation die $50_1$ continues to be driven and moved in the direction of the arrow T in FIG. 6 according to the step SP52 in FIG. 29 and is driven until it reaches a retracting position EP of the right hand in the figure of the combination die support unit 47 as shown in FIG. 6. On this occasion, the edge portion installation die $50_1$ and the divisional upper dies $50_3$, $50_5$ of the subholder 12*c* are in unclamped state with the unclamped cylinder 90, as described before. Therefore, the divisional upper dies $50_5$, $50_3$ and the edge portion installation die $50_1$, held with the slide block 55*h*, can smoothly move in the subholder 12*c* in the direction of the arrow T in FIG. 6. On this occasion, the arrangement order of respective divisional upper dies 50 in the partial upper die 13*a* and the arrangement order of the divisional upper dies 50 held with the slide block 55*h* don't change in the directions of the arrows S and T in FIG. 6. Besides, the divisional upper dies 50 are arranged so as to contact with one another in the subholder 12*c* and so as to depart from one another on the slide block 55*h*. Accordingly, with respect to the respective divisional dies 50 comprising the partial upper die 13*a* of FIG. 35, the transfer operations of the divisional upper dies 50 with the slide block 55*h* are executed in the order of the divisional upper die $50_5$, the divisional upper die $50_3$ and the edge portion installation die $50_1$ so as to be held and transferred on the slide block 55*h*.

When the carriage 55 reaches the retracting position EP in this way, the program proceeds to the step SP53 in FIG. 29. The positioning pin 89 as shown in FIG. 6 is released and the chain carrying unit 37 of the upper die storing unit 33 is properly rotated and driven with the driving motor 34 through the sprockets 42 in the directions of the arrows J and K in FIG. 5. Then, the divisional die support unit 46 (that is, the divisional die support unit 46 storing the divisional upper dies 50 selected at the step S2 of the die supply program MSP as shown in FIG. 32) storing the divisional upper dies $50_5$, $50_3$ and the edge portion installation die $50_1$ held with the slide block 55*h*, which is arranged so as to be adjacent to the combination die support unit 47, is positioned at the die supply position P1 of the divisional die select station 51 as shown in FIG. 5. On this occasion, since the carriage 55 of the divisional die select station 51 is positioned at the retracting position EP in the right hand in FIG. 6, the movement operations of the divisional die support unit 46 with the chain carrying unit 37 are smoothly executed without collision between the carriage 55, and the divisional die support unit 46 and the like.

When the divisional die support unit 46 is positioned at the predetermined die supply position P1 in this way, the program proceeds to the step SP55. Then, the die storing unit control portion 83 drives the positioning pin unit 89 provided at the die supply position P1 as shown in FIG. 6, into the die support unit 46 so as to correctly position and hold the die support unit 46 at the die supply position P1. Next, the program proceeds to the step SP56. The die select station control portion 80 drives the driving cylinder 55*i* as shown in FIG. 5 so as to retract the slide block 55*h* together with the transferred divisional upper dies 50 in the direction of the arrow K, and rotates and drives the driving motor 55*b* of the die select station 51 so as to move and drive the carriage 55 through the timing belt 55*c* and the like on the guide rails 52*a* in the left hand in FIG. 6 and so as to position the slide block 55*h* on the carriage 55 at the position facing the die support unit 46 positioned at the die supply position P1, as shown in FIG. 5.

When the slide block 55*h* faces the die support unit 46, the program proceeds to the step SP57. The driving cylinder 55*g* on the carriage 50, facing the portion on which the divisional upper die 50 of the divisional die support unit 46 isn't installed, that is, the place at which the divisional upper die 50 on the slide block 55*h* is to be stored, is selectively driven so as to protrude the rod 55*t* in the direction of the arrow L. Then, the slider 46*e* at the place of the die support unit 46, having no die at present, abuts on and engages with the protruded rod 55*t* so as to selectively unclamp a die holding means comprising the engagement portion 46*g* and the engagement groove 46*d* at the portion.

Then, the die return program MRP proceeds to the step SP58. The driving cylinder 55*i* is driven so as to move the slide block 55*h* in the direction of the arrow J, that is, to the side of the divisional die support unit 46 positioned at the die supply position P1. Then, with respect to each divisional upper die 50 held on the slide block 55*h*, the engagement groove 50*b* formed on the side face of the holding portion 50*a* of each divisional die 50 is fitted in the engagement groove 46*d* and the engagement portion 46*g* of the divisional die support unit 46, being in unclamped state. Since the arrangement of the divisional upper dies 50 on the divisional die support unit 46 and the slide block 55*h* is set so as to contrast with each other, as described before, the divisional upper dies 50 on the slide block 55*h* are smoothly inserted in the installation portion having no divisional upper die 50, of the divisional die support unit 46.

Next, at the step SP59, the driving of the driving cylinder 55*g* is released and the slider 46*e* corresponding to the edge portion installation die $50_1$ and the divisional upper dies $50_3$, $50_5$ respectively is driven in the direction of the arrow M in FIG. 6 so as to support those divisional upper dies 50 with the divisional die support unit 46 side. And, the rod 55*u* of the driving cylinder 55*s* at the side of the slide block 55*h* which had held the upper dies 50 till then, is protruded in the direction of the arrow L and the slider 55*p* is moved in the direction of the arrow L so as to release the supporting state of the divisional upper dies 50 with the slider 55*p*.

And, the program proceeds to the step SP60 in FIG. 29. The driving cylinder 55*i* is driven so as to move the slide block 55*h* in the direction of the arrow K. Then, the divisional upper dies 50 are held with the divisional die support unit 46 and the carriage 55 is driven and moved in the direction of the arrow S in FIG. 6 so as to be returned to a predetermined waiting position WP in the left hand in the figure. Then, the execution of the die supply program MSP finishes.

Heretofore, the present invention has been explained on the basis of the above-described embodiments. But, the embodiments which are mentioned in the present specification are merely exemplary. The scope of the invention is designated by the accompanying claims, and is not be restricted by the descriptions of the preferred embodiments. Accordingly, alteration and deformation belonging to the claims are in the scope of the present invention.

We claim:

1. An apparatus for providing dies having selectable sizes to a press brake, comprising:

a die storing means for storing a plurality of divisional dies having a plurality of face widths;

a die selecting and combining unit for assembling a partial die having a predetermined face width by combining a plurality of said divisional dies in said die storing means; and a carrying means for carrying said partial die from said die selecting and combining unit to said press brake.

2. The apparatus according to claim 1, wherein said carrying means is provided with said die storing means.

3. An apparatus for providing dies having selectable sizes to a press brake, comprising:

a die storing means for storing a plurality of divisional dies having a plurality of face widths;

a die selecting and combining unit for assembling a partial die having a predetermined face width by combining a plurality of said divisional dies in said die storing means;

a carrying means for carrying said partial die from said die selecting and combining unit to a die waiting position adjacent to the press brake; and, a die supplying means for supplying said press brake with said partial die from said die waiting position.

4. The apparatus according to claim 3, wherein said carrying means is provided with said die storing means.

5. An apparatus for removing and storing dies used on a press brake, comprising:

a carrying means for removing and carrying a partial die used for machining from a press brake;

a die demounting and restoring means for demounting said partial die from said carrying means and restoring said partial die into a plurality of divisional dies having a plurality of face widths; and, a die storing means for storing said plurality of divisional dies which have been demounted and restored with said die demounting and restoring means.

6. The apparatus according to claim 5, wherein said carrying means is provided with said die storing means.

7. An apparatus for removing and restoring dies used on a press brake, comprising:

a die removing means for removing a partial die used for machining from a press brake to a die waiting position adjacent to said press brake;

a carrying means for carrying said partial die removed from said press brake with said die removing means;

a die demounting and restoring means for demounting said partial die from said carrying means and restoring said partial die into a plurality of divisional dies having a plurality of face widths; and, a die storing means for storing said plurality of divisional dies which have been demounted and restored with said die demounting and restoring means.

8. The apparatus according to claim 7, wherein said carrying means is provided with said die storing means.

* * * * *